US007157197B2

(12) United States Patent
Aoki et al.

(10) Patent No.: US 7,157,197 B2
(45) Date of Patent: Jan. 2, 2007

(54) ELECTROPHOTOGRAPHIC PHOTOSENSITIVE MEMBER

(75) Inventors: Makoto Aoki, Yokohama (JP); Satoshi Kojima, Mishima (JP); Motoya Yamada, Numazu (JP); Kazuto Hosoi, Mishima (JP); Jun Ohira, Shizuoka (JP); Hironori Owaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 11/377,388

(22) Filed: Mar. 17, 2006

(65) Prior Publication Data

US 2006/0160004 A1 Jul. 20, 2006

Related U.S. Application Data

(63) Continuation of application No. PCT/JP05/020766, filed on Nov. 7, 2005.

(30) Foreign Application Priority Data

Nov. 5, 2004 (JP) ..... 2004-322760
Nov. 5, 2004 (JP) ..... 2004-322772

(51) Int. Cl.
*G03G 5/147* (2006.01)

(52) U.S. Cl. ..... 430/66; 430/67; 399/159

(58) Field of Classification Search ..... 430/66, 430/67, 57.4, 57.7, 58.1; 399/159
See application file for complete search history.

(56) References Cited

U.S. PATENT DOCUMENTS 4,795,691 A * 1/1989 Takei et al. ..... 430/67

FOREIGN PATENT DOCUMENTS

| | | | |
|---|---|---|---|
| JP | 1-289963 | | 11/1989 |
| JP | 02012264 A | * | 1/1990 |
| JP | 5-11480 | | 1/1993 |
| JP | 5-61229 | | 3/1993 |
| JP | 5-119501 | | 5/1993 |
| JP | 5-150532 | | 6/1993 |
| JP | 6-266139 | | 9/1994 |
| JP | 8-171220 | | 7/1996 |
| JP | 2002-311693 | | 10/2002 |

* cited by examiner

*Primary Examiner*—Christopher Rodee
(74) *Attorney, Agent, or Firm*—Fitzpatrick, Cella, Harper & Scinto

(57) ABSTRACT

An electrophotographic photosensitive member is provided which can keep at a minimum the absorption of image exposure light of 380 to 500 nm in wavelength in its surface layer and concurrently can satisfactorily keep electrophotographic properties including resolving power. The electrophotographic photosensitive member has a substrate, and a photoconductive layer and a surface layer in this order provided on the substrate. The surface layer includes an amorphous material composed chiefly of silicon atoms and nitrogen atoms and containing at least oxygen atoms and carbon atoms, and the ratios of the numbers of the respective oxygen atoms, carbon atoms and nitrogen atoms to the total number of oxygen atoms, carbon atoms and nitrogen atoms contained in the amorphous material are each within a specific range.

17 Claims, 4 Drawing Sheets

ELECTROPHOTOGRAPHIC PHOTOSENSITIVE MEMBER

This application is a continuation of International Application No. PCT/JP2005/020766, filed on Nov. 7, 2005, which claims the benefit of Japanese Patent Application Nos. as follows:

1) 2004-322760 filed on Nov. 5, 2004
2) 2004-322772 filed on Nov. 5, 2004

BACKGROUND OF THE INVENTION

1. Field of the Invention

This invention relates to an electrophotographic photosensitive member and an electrophotographic apparatus making use of the same, and more particularly relates to an electrophotographic photosensitive member most suited for printers, facsimile machines, copying machines and so forth in which light of 380 nm or more to 500 nm or less in wavelength is used in exposure, and an electrophotographic apparatus making use of the same.

2. Related Background Art

In electrophotographic apparatus used as printers, facsimile machines, copying machines and so forth, a photosensitive member charged electrostatically by a charging member is irradiated with light and the areas other than those corresponding to images or the areas corresponding to images are exposed to light to form, on the photosensitive member, electrostatic latent images corresponding to the images. Then, a toner is fed thereto to develop the electrostatic latent images, and the toner having adhered to the electrostatic latent images is transferred to a transfer material and thereafter fixed thereto. Meanwhile, the surface of the photosensitive member from which toner images have been transferred to the transfer material is de-charged. Through these steps, the formation of images is performed.

Photoconductive materials in photosensitive members used in the image formation of such electrophotographic apparatus are required to have properties such that they are highly sensitive, have a high SN ratio [light current (Ip)/dark current (Id)], have absorption spectra adapted to spectral characteristics of electromagnetic waves to be applied, have a high response to light, have the desired dark resistivity and are harmless to human bodies when used. In particular, in the case of photosensitive members set in electrophotographic apparatus used as business machines in offices, the harmlessness in their use is important. As a photoconductive material showing such superior properties, amorphous silicon (hereinafter also simply "a-Si") is available, and is widely used as a light-receiving material of the electrophotographic photosensitive member.

In such photosensitive members making use of amorphous silicon, it is common to form a photoconductive layer composed of a-Si, on a conductive substrate heated to 50° C. to 350° C., by a film forming process such as vacuum deposition, sputtering, ion plating, heat-assisted CVD, light-assisted CVD or plasma-assisted CVD. In particular, the plasma-assisted CVD is preferably employed in which source gases are decomposed by high-frequency or microwave glow discharging to form a-Si deposited films on the substrate. On the photoconductive layer thus formed, a surface layer which affords durability to wear and to service environments such as temperature and humidity is superposed to produce a photosensitive member suited for practical use.

In order to achieve improvements in photoconductive properties such as dark resistivity, photosensitivity and response to light and service environmental properties such as humidity resistance, and further in stability over time, running (extensive operation) performance and so forth of photoconductive members having the photoconductive layer constituted of such an amorphous-silicon deposited film, a photosensitive member is proposed in which an a-Si:N photosensitive member comprising a substrate, a barrier layer, a photoconductive layer and a surface layer is produced from $SiH_4$, $H_2$, $N_2$ and $B_2H_6$ and is so constituted as to be in a bias state reverse to p-i-n junction, by specifying source gas flow rates for the respective layers, as disclosed in, e.g., Japanese Patent Application Laid-open No. H05-150532. Japanese Patent Application Laid-open No. H08-171220 also discloses an electrophotographic photosensitive member having on a conductive substrate a photoconductive layer formed of a-Si and a surface layer formed of amorphous silicon nitride, wherein in the outermost surface of the photosensitive member, the element compositional ratio of N/Si ranges from 0.8 to 1.33 and the element compositional ratio of O/Si ranges from 0 to 0.9.

In addition, methods for electrostatically charging such an a-Si photosensitive member include a corona charging method, which makes use of corona charging; a roller charging method, which makes use of a charging roller and performs charging by direct discharging; and an injection charging method, which secures contact area sufficiently by using magnetic particles or the like and provides electric charges directly to the photosensitive member surface to perform charging. In particular, the corona charging method and the roller charging method make use of discharging, and hence discharge products tend to adhere to the photosensitive member surface. In addition, the a-Si photosensitive member has a surface layer having much higher hardness than an organic photosensitive member, and hence the discharge products tend to remain on the surface, where the discharge products and moisture may combine because of adsorption of moisture in an environment of high humidity or the like. This may cause the surface to have a low resistivity to easily move surface electric charges and result in a phenomenon of image deletion. Hence, various measures have been required to be employed in some cases on how to rub the surface and how to perform temperature control.

On the other hand, the injection charging method is a charging method in which electric charges are directly provided from the part having come into contact with the photosensitive member surface without using discharging, and hence the phenomenon called image deletion can not easily take place.

In addition, the injection charging method, which is a contact charging method, is of a voltage control type, while the corona charging method is of a current control type. Hence, the former has such an advantage that any non-uniformity of charging potential can be relatively easily reduced.

In conventional a-Si photosensitive members, the improvements of properties have each individually been achieved in respect of electrical, optical and photoconductive properties such as dark resistance values, photosensitivity and photoresponsiveness, and further in respect of durability over time and running performance. In the actual circumstances, however, there is room for further improvement in order to achieve overall improvement in properties.

In particular, in recent years, the transition to digital processing and color image formation has rapidly advanced, and electrophotographic apparatus are more highly required than ever to achieve high image quality. The high image quality herein termed refers to being high-resolution, being high definition, being free of density non-uniformity, and being free of image defects (such as blank areas or voids and black dots). Besides, the electrophotographic apparatus are also rapidly more required to have more high-speed and higher running performance, and, in electrophotographic photosensitive members, it is sought to improve electrical properties and photoconductive properties, to improve uniformity and reduce image defects, and also to greatly enhance performances including running performance and environmental resistance (adaptability to changes in temperature and humidity).

For example, in order to enhance the resolution of images, it is effective for toners to have a small particle diameter and also for laser beams for image formation to have a small spot diameter. Means for reducing the spot diameter of a laser beam include improving the precision of an optical system through which laser beams are applied to the photoconductive layer, and increasing the aperture ratio of an image forming lense. In order to increase the aperture ratio of an image forming lense, the lense must be made large and mechanical precision must be improved. For such reasons, it is difficult to avoid enlarging an apparatus and causing a rise in cost.

Accordingly, in recent years, research is focused on a technique in which laser beams are made to have a short wavelength to reduce the spot diameter small and to enhance the resolution of electrostatic latent images. This relies on the fact that the minimum value of the spot diameter of a laser beam is in direct proportion to the wavelength of the laser beam. In conventional electrophotographic apparatus, laser beams having an oscillation wavelength of 600 to 800 nm have been commonly used in performing image exposure. Making this wavelength shorter can make the resolution of images higher. In recent years, the development of semiconductor lasers having short oscillation wavelengths has rapidly advanced, and semiconductor lasers having an oscillation wavelength of about 400 nm have been put into practical use. Thus, it has been sought to provide a photosensitive member adaptable to the light of such a short wavelength band.

As for a measure taken when such short-wavelength light is used, Japanese Patent Application Laid-open No. 2000-258938 discloses an image forming apparatus characterized in that a photosensitive layer is a layer which contains a-Si hydride and that an exposure means has an ultraviolet bluish-purple laser beam oscillator having a chief oscillation wavelength of 380 nm to 450 nm. Japanese Patent Application Laid-open No. 2002-311693 discloses an electrophotographic apparatus characterized in that an a-Si type photosensitive member is used and that an electric field applied to the photosensitive member at the time point of exposure to image forming light beams is 150 kV/cm or more and the image forming light beams have a wavelength of 500 nm or less.

Where a semiconductor laser having an oscillation wavelength of about 400 nm is used in imagewise exposure, photosensitive members are sought firstly to have sufficient sensitivity to exposure wavelength light, and secondly to absorb almost no exposure wavelength light in the surface layer. The a-Si type photosensitive layer has a peak sensitivity at about 600 to 700 nm, and hence it has a sensitivity at about 400 to 410 nm, though being a little inferior to the peak sensitivity, if conditions are skillfully designed. For example, it is usable even when a 405 nm short-wavelength laser is used. Nevertheless, in respect of sensitivity, it may have a half sensitivity or thereabout compared with the peak sensitivity. In such a case, it is therefore preferable that almost no absorption takes place at the surface layer. However, in the cases of amorphous silicon carbide (hereinafter "a-SiC") type materials and amorphous carbon (hereinafter "a-C") type materials both having conventionally preferably been used in the surface layer, there has been a tendency for the absorption to take place greatly at about 400 to 410 nm. More specifically, when the a-SiC type materials are used, it has been possible for the surface layer to be improved in transmittance by skillfully designing conditions and also to be managed by setting its layer thickness to be small to a certain degree. However, the surface layer is fated to be gradually scraped on by friction in the copying machine, and hence it is required to have a certain or more layer thickness in order to make full use of the property the a-SiC type materials have, i.e., the long lifetime. Thus, it has come about in some cases that the absorption and lifetime in the surface region fall into the relation of a trade-off. Also, in the case of the a-C type materials, it has been possible to form a film having a good transmittance, depending on conditions. In such a case, however, the film may have a structure close to a polymer to have a low hardness and have a too high resistance. Thus, in the case of the a-C type materials, it has come about in some cases that the transmittance and the hardness or the resistivity are incompatible with each other.

In contrast with these materials, where amorphous silicon nitride (hereinafter "a-SiN") type materials are used, it has been known that the coefficient of absorption at about 400 to 410 nm can be lowered by optimizing conditions. However, such a film is difficult to use as the surface layer of the photosensitive member, and has never been put into practical use.

Conditions for forming an a-SiN type film suitable for the surface layer are disclosed also in Japanese Patent Application Laid-open No. H05-150532 (Patent Document 1). However, even in this case, as the wavelength of light used in exposure, up to 550 nm is only taken into account. Moreover, even at such an exposure wavelength of 550 nm, a low sensitivity results when the surface layer has a layer thickness of more than 0.8 μm.

SUMMARY OF THE INVENTION (Subject to be Solved by the Invention)

A subject of the present invention is to provide an electrophotographic photosensitive member which has a surface layer causing almost no absorption of about 380 to 500 nm short-wavelength light and having wear resistance, has an especially high image resolution, is superior in electrophotographic properties such as a dark resistance value, photosensitivity, photoresponsiveness and no photomemory, and can be improved in overall properties such as service environmental properties, stability with time and running performance; and an electrophotographic apparatus having such a photosensitive member.

(Means for Solving the Subject)

The present inventors have made extensive studies in order to obtain an electrophotographic photosensitive member which is preferably usable in a copying process with a high image quality and a high speed, has a sensitivity to short-wavelength exposure light that is sufficient for practical use, is free of photomemory, can materialize a copying process with a high chargeability and a high contrast, and can be improved in overall properties such as service environmental properties, stability with time and running performance.

The present inventors formed a thin film from an a-SiN:H type material, preferable as the surface layer, by a conventional method as disclosed in Japanese Patent Application Laid-open No. H08-171220. However, it turned out that the film formed by such a known method has a relatively large coefficient of absorption to short-wavelength light, e.g., the light of 400 to 410 nm, and, in a photosensitive member having such a surface layer, may have an insufficient sensitivity to the light of about 400 to 410 nm in wavelength.

As a result of repeated studies made thereafter, it turned out that a surface layer having less absorption of short-wavelength light of 405 nm or so was not obtainable until the types, flow rates and proportions of source gases, the ratio of electric power to be applied to the amounts of gases, and so forth were appropriately set and the surface layer was formed in the specific ranges to which these were limited. Here, the film having less absorption refers to a film whose absorption coefficient $\alpha$ represented by the following equation is 5,000 $cm^{-1}$ or less, and preferably 3,000 $cm^{-1}$ or less, in quantitative representation:

$$\alpha=(1nT/T0)/t$$

where the amount of light of incident light is represented by T0; the amount of light of transmitted light, by T; and the layer thickness, by t (cm).

The surface layer formed under such specific conditions was analyzed by XPS (X-ray photoelectron spectroscopy), RBS (Ratherford back scattering spectroscopy), SIMS (secondary-ion mass spectroscopy) or the like after the removal of the part having undergone contamination or the like at its outermost surface. As a result, it turned out that the content of nitrogen atoms was preferably in the range of 0.3 or more and more preferably 0.35 or more when expressed by N/(Si+N) (where N represents the number of nitrogen atoms, and Si represents the number of silicon atoms) as a value at which the absorption in a practical layer thickness was tolerable. It also turned out that its upper limit was preferably 0.7 or less, and more preferably 0.6 or less, from the viewpoint of yield. Where the surface layer was formed under conditions beyond this range, it turned out that its layer thickness, hardness, resistivity and so forth tended to become non-uniform, resulting in a very low yield in some cases. The reason therefor was presumed to be that bonds in the film became very unstable because of a too large nitrogen atom content. Also, it turned out that the range of 0.7 or less was more preferable when the film was used as the surface layer, because its strength was retained.

Here, the part having undergone contamination or the like at its outermost surface refers to the part influenced by adsorbed elements and by oxide films formed on the surface. As a method by which this part having undergone contamination or the like is removed, a means may be employed in which the surface is subjected to sputtering in vacuum by using Ar atoms or the like, to remove the surface portion by about 10 nm, and preferably about 20 nm. For example, when measured by SIMS or the like after a conductive film for preventing charge-up is formed by vacuum deposition, the sputtering may be carried out for the part corresponding to the layer thickness found by summing up the thickness of the deposited film and the removed-layer thickness of about 20 nm.

In order to find out materials for the surface layer which enable a laser for exposure to have a small spot diameter, from a different point of view, the present inventors made studies on the relationship between spot diameters and dot diameters on reproduced images or on electrostatic latent images held on photosensitive members at the time the following photosensitive members (1) to (5) having an amorphous silicon type photoconductive layer and various amorphous silicon nitride type surface layers were image-wise exposed using laser beams of 655 nm and 405 nm in wavelength. Every photosensitive member was irradiated with the laser beams, and the results were plotted on a graph with the laser spot diameter as abscissa and the dot diameter on electrostatic latent images or reproduced images as ordinate. As a result, it turned out that as shown in FIG. 6, in the case in which the 655 nm laser beam was used [the case (1) in FIG. 6; hereinafter "photosensitive member (1)"], a reduction in the spot diameter could manage with the number of apertures of the optical system, but was limited to a certain extent, whereas in the case in which the 405 nm laser beam was used [the cases (2) to (5) in FIG. 6; hereinafter "photosensitive members (2) to (5)", respectively], the spot diameter can be further be narrowed because the short-wavelength exposure light was used.

The difference in exposure wavelength also influences the absorption of light in the photoconductive layer. At a short exposure wavelength, the absorption of light in the photoconductive layer is limited to a very thin region. Carriers produced by light are accelerated by the electric field generated by surface electric charges, and move in the thickness direction of the film. Then, carriers with a polarity reverse to surface electric charges move to the surface and cancel the electric charges, whereby an electrostatic latent image is formed. However, the carriers possibly move also in the plane direction (the direction vertical to the thickness direction) of the film because of electrostatic repulsion force acting between carriers themselves. This is likely to cause the latent image to blur. Accordingly, in order to form an electrostatic latent image pattern more faithful to an exposure pattern, it is more preferable to shorten the distance through which the carriers produced by light move to cancel the surface electric charges, that is, it is more preferable that the region where the light carriers are produced is near to the surface. In the case of conventional exposure to light of 600 to 800 nm in wavelength, the light reaches the upper part of the photoconductive layer of several micrometers to tens of micrometers in depth because of optical properties of the a-Si photosensitive member to cause the production of carriers. On the other hand, in the case of exposure to light of, e.g., 400 nm in wavelength, the absorption of light is completed in a very thin region at the uppermost part of the photoconductive layer, and there is almost no room for the carriers produced by light to spread to reach the above upper part. Hence, it follows that a further high resolution can be expected. From this fact, it can be expected that a difference in resolution occcurs even if spot diameters are the same, which correspond to (1) and (2) at the position A on the abscissa in FIG. 6.

On the other hand, because of the ability of the photosensitive member, a case may come about in which the spot diameter can no longer be made small even if the spot diameter is narrowed beyond a certain extent. For example, even when the same 405 nm wavelength light is used as a laser beam and the minimum spot diameter is in the same size, the dot diameter on reproduced images or on electrostatic latent images held on the photosensitive member can not be made small in the case of the photosensitive member (5), compared with the photosensitive members (2) to (4). It is shown that no advantage resulting from making the spot diameter small is obtainable in some cases even if the image exposure is performed using laser beams having the same short wavelength. To the contrary, in the photosensitive members (3) and (4), when the spot diameter is narrowed to minimum, the spot diameter can be made smaller than the dot diameter on reproduced images or latent images in a photosensitive member (B) having thereon the same minimum spot diameter. Thus, it turned out that even if production conditions were skillfully designed to form an amorphous silicon nitride type film having a good light-transmitting property to short-wavelength laser beams, this was not directly connected with the improvement in resolution in some cases. In the photosensitive member (5), it was presumed that probably the latent images became blurred because of defects present in the film such as the surface layer. In the photosensitive members (3) and (4), it was expectable that the resolution was further improved by optimizing the surface layer.

Accordingly, the present inventors reviewed production conditions variously, aiming at optimizing the ability of the surface layer. As a result, it turned out that the resolution was more improvable while holding small the coefficient of absorption to 380 to 500 nm light, by adding a slight amount of oxygen atoms.

The reason therefor is still unknown, and it is considered that bonds in the a-SiN type film having a large stress became relaxed by adding a slight amount of oxygen atoms and/or carbon atoms, and consequently the defects were lessened. As stated previously, the a-SiN type film having a high nitrogen atom concentration has a small coefficient of absorption and also has a very high hardness, and hence is preferably used as the surface layer. However, the film having a high hardness may have a large stress therein, where a very large residual stress may remain in the film. It is considered that in such a case, the strain due to the stress is relaxed and the bonds are broken, so that defects come about after film deposition. Oxygen has two bond valences, and hence is expected to be so act as to enter between atoms and effectively relax the strain of bonds, thus probably the defects can effectively be prevented from coming about. By adding carbon as well, such flexible bonds as exemplified by C—N bonds and C═N bonds can be introduced besides Si—C bonds, and hence this is considered to cause the relaxation of bonds.

However, in an attempt to sufficiently effect stress relaxation by using oxygen alone in order to improve the a-SiN type film, the film tended to have a high resistance although its light-transmitting property did not change. Also, in an attempt to sufficiently effect stress relaxation by using carbon alone, the film tended to bring about a decrease in light-transmitting property for short-wavelength light although its resistance did not change. The present inventors found that only the relaxation of bonds can be promoted without causing such disadvantages, by mixing oxygen atoms and carbon atoms in appropriate levels.

Here, the reason why no remarkable improvement in resolution is seen in some cases in the photosensitive member having such a surface layer formed of the amorphous silicon nitride type film with the addition of hydrogen is considered to be probably that although hydrogen termination or the like is effective in remedying the defects during film formation, forced bonds and weak bonds are broken because of thermal stress after film deposition to change into the defects. It is considered that probably the relaxation of bonds takes place in virtue of the presence of a slight amount of oxygen and carbon present, and, in parallel with the remedy of defects in virtue of hydrogen, effectively lessens defects having come about after film formation. Thus, the achievement of lessening the defects reduces shallow traps present in the film, so that carriers bound by the traps after charging for example are no longer again excited to come out until development is performed. In surface layers of conventional photosensitive members, carriers coming out of such shallow traps are considered to so drift as to fill out the potential difference produced by the formation of latent images, and hence they are considered to inevitably make the latent images dull or make the depth of latent images small. Thus, it is considered that, as long as the traps can be lessened, the causes that make the latent images dull are lessened and the resolution is improved.

Where oxygen aroms and carbon aroms are in a small level, the same action as valence electron controllable impurities is also presumed to come about, and is considered to remedy the inconformity of band structure. The inconformity of band structure is likely to cause the accumulation and sideway flow of carriers, and possibly lowers the resolution of the photosensitive member. The oxygen atoms and carbon atoms which are contained in the film in a small level are considered to contribute to remedying the incomformity of band structure. On the other hand, if they are added in a too high level, it turned out that they served not as additives but as structural materials to cause the film to have a low hardness, or a high resistance to increase residual potential, or they came to be resemble to SiC to lower the light-transmitting property of the film, or the number of hydrophilic SiO bonds increased to cause the blurring of images in a high-temperature and high-humidity environment. it turned out that the content of oxygen atoms was preferably 0.01 atm % or more to 20 atm % or less, and more preferably 0.5 atm % or more to 10 atm % or less, in an average concentration in the film after the removal of the part having undergone contamination or the like at the outermost surface and in terms of O/(Si+N+O+C). In regard to carbon as well, it turned out likewise that its content was preferably 0.01 atm % or more to 10 atm % or less, and more preferably 0.5 atm % or more to 5 atm % or less, in an average concentration in the film after the removal of the part having undergone contamination or the like at the outermost surface and in terms of C/(Si+N+O+C).

It also turned out that the electrophotographic properties can further be improved by incorporating oxygen atoms so as to have such a gradient composition that the oxygen atom concentration comes to be higher toward the open surface.

The relationship between the concentration distribution of oxygen atoms and the improvement of the properties has not been revealed, but it is considered that as stated previously, a too high oxygen atom concentration may inevitably affect the electrophotographic properties because of a high resistance of the film, but increasing the oxygen atom concentration gradually toward the surface enables the defects to be prevented from coming about in virtue of the relaxation of bonds while balancing the electrophotographic properties. Due to such concentration distribution of oxygen atoms, a further reduction in photomemory can be realized. The reason therefor is unclear, and is considered due to the inclination of band structure that takes place in virtue of the concentration distribution of oxygen atoms to make the flow of carriers smoother.

Also in regard to the distribution of nitrogen atoms in the surface layer, it turned out that the electrophotographic properties and the yield can be improved by causing nitrogen atoms to have such thickness direction distribution that they come to be in a higher concentration toward the open surface. In regard to the reason therefor, it is considered as follows: As stated previously, nitrogen atoms present in a large content, though advantageous in some aspect in respect of properties, causes a low yield in some cases. However, it is considered that the presence of nitrogen atoms in a gradient distribution state creates a gradual change in composition and cancels an unstable state of bonds to consequently create an improvement in properties and an improvement in yield. It is also considered that as in the case of oxygen atoms, a smooth flow of carriers is materialized due to the band structure gradient, thereby improving resolution and anti-ghost properties.

In addition, it turned out that where in the surface layer the number of nitrogen atoms contained per unit length in the thickness direction is represented by N, and the number of oxygen atoms contained per unit length in the thickness direction by O, the resolution and anti-ghost properties were further improved by increasing O/N toward the open surface. This shows that where the number N of nitrogen atoms is constant, the number O of oxygen atoms may preferably increase toward the open surface, and, where the number N of nitrogen atoms increases gradually, the rate of increase in the number O of oxygen atoms may preferably be always larger than the rate of increase in the number N of nitrogen atoms. The reason therefor is considered to be probably that although the strain of bonds increases with an increase in nitrogen atoms, the oxygen atoms relax such strain, and the presence of oxygen atoms which are always more than nitrogen atoms desirably relaxes the strain.

The surface layer in the present invention is also most suitable to achieve high definition and high image quality, and hence exhibits the greatest effect when used in high image quality machines which put importance on print image quality, in particular, full-color machines. Color toners are more advantageous especially as negatively chargeable toners in respect of properties, and for the formation of images, a high image quality is more readily achievable by using in combination the image exposure method (IAE) and a system which develops portions the potential of which has attenuated upon exposure (reversal development). From this fact, taking the combination of these into account, it follows that it is preferable for the photosensitive member to be a negatively chargeable photosensitive member. In such a case, in order to keep electrons from entering from the upper part, it is more preferable for the photosensitive member to have between a photoconductive layer and the surface layer an upper-part charge injection blocking layer formed of an amorphous material composed chiefly of silicon atoms and nitrogen atoms and containing a Group 13 element in the periodic table (hereinafter referred to also as a "periodic-table Group 13 element"). Inasmuch as the upper-part charge injection blocking layer is also formed of an a-SiN type material, the absorption in this layer can be made very small, thus, needless to say, this is especially advantageous when the exposure light of 380 to 500 nm in wavelength is used.

It also turned out that a photosensitive member having i) between the photoconductive layer and the upper-part charge injection blocking layer a gradient-composition layer including an amorphous material composed chiefly of silicon atoms and nitrogen atoms and containing the silicon atoms and the nitrogen atoms in such a way that the value of N/Si which is the ratio of the number Si of silicon atoms contained per unit length in the thickness direction to the number N of nitrogen atoms contained per unit length in the thickness direction increases toward the upper-part charge injection blocking layer and/or ii) between the upper-part charge injection blocking layer and the surface layer a change layer including an amorphous material composed chiefly of silicon atoms, nitrogen atoms and carbon atoms and containing the silicon atoms, the nitrogen atoms and the carbon atoms in such a way that the compositional ratio between the number of silicon atoms, the number of nitrogen atoms and the number of carbon atoms which are contained per unit length in the thickness direction changes continuously, was more preferable because it had optically no distinct reflective surface and because sensitivity non-uniformity was able to be prevented from being caused by microscopic layer thickness non-uniformity and microscopic scrape non-uniformity of the surface.

Materials for the upper-part charge injection blocking layer in the present invention may also be skillfully designed, whereby the absorption in this layer also can be significantly reduced. This is especially advantageous when the short-wavelength exposure light is used. It turned out that, for this end, in an upper-part charge injection blocking layer composed chiefly of silicon atoms and carbon atoms, the carbon atoms may preferably be in an average concentration ranging from 10 atm % or more to 50 atm % or less, and more preferably from 15 atm % or more to 40 atm % or less, as expressed by C/(Si+C). If the carbon atom concentration is too low, a large absorption may result. If on the other hand it is too high, poor valence electron controllability may result to lower blocking ability. Inasmuch as the upper-part charge injection blocking layer is made to have composition within the above range, a photosensitive member can be materialized which has sufficient blocking ability while holding the absorption in the upper-part charge injection blocking layer as small as possible. It turned out that the periodic-table Group 13 element to be incorporated in the upper-part charge injection blocking layer may most preferably be boron, and may preferably be in a content of from 50 atm ppm or more to 3,000 atm ppm or less, and more preferably from 100 atm ppm or more to 2,000 atm ppm or less, based on the content of silicon atoms. If its concentration was too low, the ability to block electrons tended to be insufficient. If on the other hand it was too high, holes or the carriers produced by light tended to flow sideways in the in-plane direction to make the resolution poor in some cases. Thus, it turned out that, inasmuch as that element was in the concentration within the above range, a photosensitive member was able to be materialized having sufficient resolving power while securing the blocking ability required in the upper-part charge injection blocking layer.

In addition, it turned out that the layer thickness of the upper-part charge injection blocking layer may preferably be from 5 nm or more to 150 nm or less, more preferably 100 nm or less, and still more preferably 50 nm or less. If the layer was too thin, in some cases, poor chargeability resulting from an insufficient blocking ability or photomemory occurred seriously. If on the other hand it was too thick, a large absorption resulted in some cases. Thus, it turned out that, inasmuch as the layer thickness was within the above range, the properties and absorption of the upper-part charge injection blocking layer was able to be balanced.

It also turned out that it was more preferable for the photosensitive member to have i) between the photoconductive layer and the upper-part charge injection blocking layer a gradient-composition layer in which the compositional ratio of silicon atoms to carbon atoms is changed and ii) between the upper-part charge injection blocking layer and the surface layer a change layer in which the compositional ratio between silicon atoms, nitrogen atoms and carbon atoms is changed, in such a way that the composition of each film changes continuously from the photoconductive layer toward the upper-part charge injection blocking layer and surface layer. Having optically no distinct reflective surface is more preferable because sensitivity non-uniformity can be prevented from being caused by microscopic layer thickness non-uniformity and microscopic scrape non-uniformity of the surface.

The fact that the electrophotographic photosensitive member of the present invention has practically sufficient sensitivity to light of 380 nm to 500 nm in wavelength was confirmed in the following way.

FIG. 4 is a graph showing spectral sensitivity of the electrophotographic photosensitive member of the present invention. The spectral sensitivity in a photosensitive member is the following: The amount of light is measured which is required when the surface of the photosensitive member is charged to a given potential, e.g., to 450 V and thereafter irradiated with light having various wavelengths to undergo optical attenuation to a given potential. Then, the reciprocal of the amount of light, i.e., the potential attenuation level per unit energy quantity of the light per unit area ($Vcm^2/\mu J$) is determined for each wavelength, and the potential attenuation level at each wavelength is converted defining as 100 the potential attenuation level at a wavelength which gives its maximum value. The value obtained thus can be determined as the sensitivity at each wavelength.

FIG. 4 is a graph on which potential attenuation levels in the electrophotographic photosensitive member of the present invention at various wavelengths are plotted, with wavelength as abscissa and converted potential attenuation level, i.e., sensitivity as ordinate. It was ascertainable that the photosensitive member had practically serviceable sensitivity as such, in respect of the light of 380 nm or more to 500 nm or less in wavelength.

In the electrophotographic photosensitive member, it is preferable that the potential attenuation level per unit energy quantity as a result of exposure is 300 $Vcm^2/\mu J$ or more. Even if this potential attenuation level per unit energy quantity is less than 300 $Vcm^2/\mu J$, the image formation in electrophotography is possible. In practice, however, the exposure must be performed in a large amount of light, which leads to a large-size exposure unit, a rise in cost and a short lifetime. Hence, the potential attenuation level is preferably 300 $Vcm^2/\mu J$ or more, and more preferably 400 $Vcm^2/\mu J$ or more.

This potential attenuation level was measured by a method according to the method by the Kajita et al. (Academic Journal of Electrophotography, Vol. 22, first edition, 1983). Briefly, in order to reproduce behavior in a copying machine, a transparent electrode such as an ITO electrode is brought into close contact with the photosensitive member surface, the exposure and voltage application are performed in imitation of the sequence in the copying machine, and changes in potential of the surface are measured. In measuring the potential of the surface, the photosensitive member can be regarded as a capacitor, and potential may be applied thereto under direct connection with a known capacity to obtain information on the chargeability of the photosensitive member. In the method by Kajita et al., a method is employed in which a transparent insulating film is held between the photosensitive member and the ITO electrode. If designing an electric circuit skillfully, a solid capacitor may be used.

Specifically, the surface is irradiated with charge elimination (de-charging) light (e.g., 50 $mW/cm^2$) for a given time period (e.g., 0.1 second). Then, after a given time (e.g., 0.01 second) passes, a voltage is applied (e.g., for about 20 msecs.) to charge the surface. When a given time (about 0.1 to 0.5 second, e.g., 0.25 second) has passed after the voltage application is stopped, the surface of the conductor connected to the ITO electrode is measured with a potentiometer. This time period corresponds to the timing at which the potential-provided part of the photosensitive member reaches a developing assembly in a copying machine, and hence this potential corresponds to the potential at the position of developing assembly. Next, in the same sequence, the surface is irradiated with light having various wavelengths (e.g., after 0.1 second from the voltage application) between the voltage application and the potential measurement. The potential at the timing corresponding to the position of developing assembly is likewise measured, and the difference between the case where the light is applied and the case where the light is not applied is calculated. This corresponds to the measuring of the potential attenuation level due to exposure light at the position of developing assembly.

On the basis of the foregoing finding, the present inventors have accomplished the present invention.

That is, the present invention is concerned with an electrophotographic photosensitive member comprising a substrate, and a photoconductive layer and a surface layer in this order provided on the substrate, wherein;

the surface layer comprises an amorphous material composed chiefly of silicon atoms and nitrogen atoms and containing at least oxygen atoms and carbon atoms, and the amorphous material contains oxygen atoms, carbon atoms and nitrogen atoms in average concentrations represented respectively by the expressions (1) to (3):

$$0.0001 \leqq O/(Si+N+O+C) \leqq 0.2 \quad (1)$$

$$0.0001 \leqq C/(Si+N+O+C) \leqq 0.1 \quad (2)$$

$$0.3 \leqq N/(Si+N+O+C) \leqq 0.6 \quad (3)$$

(in the expressions (1) to (3), Si represents the number of silicon atoms, N represents the number of nitrogen atoms, O represents the number of oxygen atoms, and C represents the number of carbon atoms).

(Effect of the Invention)

The electrophotographic photosensitive member of the present invention can maintain the film hardness of the surface layer, can keep resistivity from increasing while keeping residual potential from increasing, can remarkably keep image exposure light from being absorbed in the surface layer, and can keep blurred images from occurring even in a high-temperature and high-humidity environment. Also, the electrophotographic apparatus of the present invention can attain a sufficient sensitivity to the light of 380 to 500 nm in wavelength, and can aim at a next-generation ultrahigh image quality electrophotographic apparatus which uses a blue-light-emitting semiconductor laser as an image exposure means, is provided with superior electrophotographic properties including a high resolution by making a laser spot diameter smaller, has superior environmental resistance or service environmental resistance, and is able to be easily manufactured.

DETAILED DESCRIPTION OF THE PREFERRED EMBODIMENTS

Figure 1A:
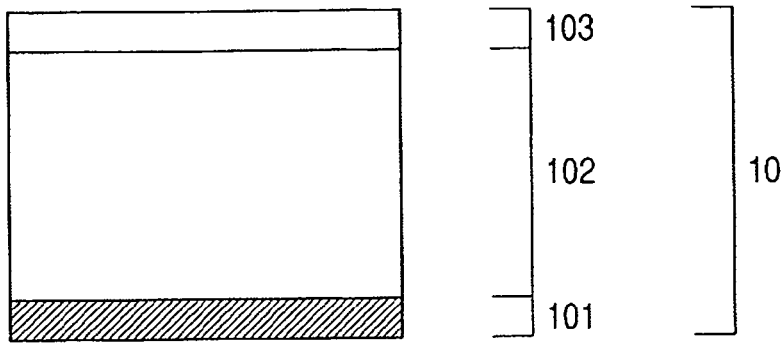
FIG. 1A is a schematic diagrammatic view showing a working example of the electrophotographic photosensitive member of the present invention.

Embodiments of the present invention are described below in detail with reference to the drawings.

FIGS. 1A to 1D are diagrammatic views each showing an example of the layer configuration of the electrophotographic photosensitive member in the present invention. As shown in Fig. A, an electrophotographic photosensitive member 10 is constituted of a substrate 101 and, superposed thereon in order, a photoconductive layer 102 and a surface layer 103, and there are no particular limitations thereon as long as the surface layer comprises an amorphous material composed chiefly of silicon atoms and nitrogen atoms and containing at least oxygen atoms and carbon atoms, and the amorphous material contains oxygen atoms, carbon atoms and nitrogen atoms in average concentrations represented respectively by the expressions (1) to (3):

$$0.0001 \leqq O/(Si+N+O+C) \leqq 0.2 \quad (1)$$

$$0.0001 \leqq C/(Si+N+O+C) \leqq 0.1 \quad (2)$$

$$0.3 \leqq N/(Si+N+O+C) \leqq 0.6 \quad (3)$$

Figure 1B:
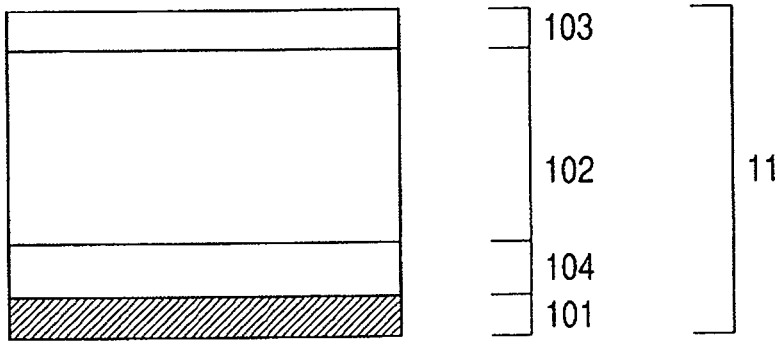
FIG. 1B is a schematic diagrammatic view showing a working example of the electrophotographic photosensitive member of the present invention.
Figure 1C:
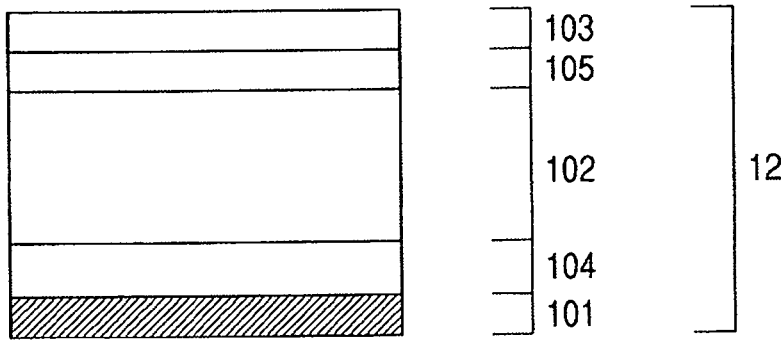
FIG. 1C is a schematic diagrammatic view showing a working example of the electrophotographic photosensitive member of the present invention.

(in the expressions (1) to (3), Si represents the number of silicon atoms, N represents the number of nitrogen atoms, O represents the number of oxygen atoms, and C represents the number of carbon atoms).

Where the substrate 101 is conductive, as shown in FIG. 1B, the electrophotographic photosensitive member of the present invention may also be provided with a lower-part charge injection blocking layer 104 on the substrate in order to block the injection of electric charges from the conductive-substrate side. Also, as shown in FIG. 1C, it may preferably be provided with an upper-part charge injection blocking layer 105 for the purpose of reducing the injection of electric charges from the upper part and improving chargeability. Such constitution is preferable especially for a negative-charging electrophotographic photosensitive member.

Figure 1D:
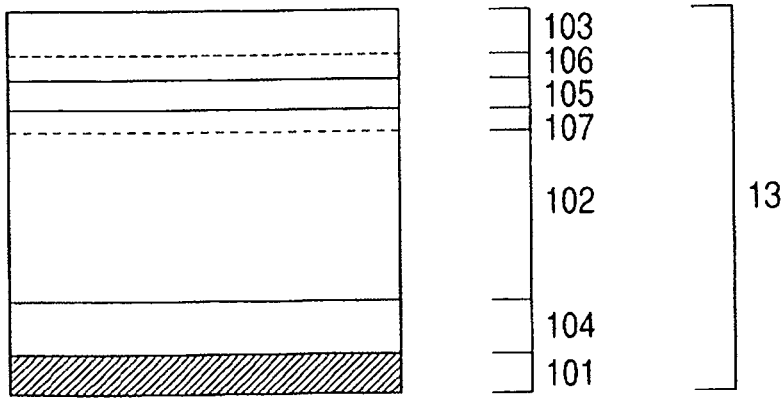
FIG. 1D is a schematic diagrammatic view showing a working example of the electrophotographic photosensitive member of the present invention.

As shown in FIG. 1D, the electrophotographic photosensitive member of the present invention may also be provided between the surface layer 103 and the upper-part charge injection blocking layer 105 with a change layer whose refractive index is continuously varied. Thus, the refractive index of the surface layer and the refractive index of the upper-part charge injection blocking layer are gently connected, whereby the reflection of light at the interface of these layers can be controlled and the optical interference at the interface can be prevented when coherent light is used in exposure. Even where light (e.g., LED light) other than the coherent light is used, the sensitivity tends to vary because of scrape if the interference takes place at such an interface, and there is a possibility that a remarkable non-uniformity of image density may inevitably come about even because of only slight scrape non-uniformity. However, the surface layer is preferable because it can keep the exposure light from reflecting at such an interface. Also, where the upper-part charge injection blocking layer and the photoconductive layer greatly differ in their refractive indexes, a gradient-composition layer 107 the refractive index of which changes gently may be provided between the upper-part charge injection blocking layer 105 and the photoconductive layer 102.

The respective layers are described below in detail.

-Substrate-

As for the substrate used in the present invention, there are no particular limitations as long as the photoconductive layer can be provided thereon. It may be electrically conductive or electrically insulating. Electrically conductive materials for such a substrate may include metals such as Al, Cr, Mo, In, Nb, Te, V, Ti, Pd and Fe, and alloys of any of these as exemplified by stainless steel.

Electrically insulating materials may include films or sheets of synthetic resins such as polyester, polyethylene, polycarbonate, cellulose acetate, polypropylene, polyvinyl chloride, polystyrene and polyamide, and glass or ceramic. In the case of such an electrically insulating substrate, it may preferably be a substrate whose surface at least on the side where the photoconductive layer is to be formed has been subjected to conductive treatment by depositing thereon a conductive substance by a process such as vacuum deposition, sputtering, electroless plating or plasma spraying.

The substrate may have the shape of a cylinder or an endless belt. This is preferable in view of the structure of the electrophotographic apparatus to which the photosensitive member is to be mounted. It may have a smooth surface or an uneven surface. Its thickness may appropriately be so determined that the photoconductive layer can be formed as desired. In instances in which the photoconductive layer is required to have a flexibility, the substrate may be made as thin as possible inasmuch as it can favorably function as a substrate. In usual instances, however, the substrate may have a thickness of 10 μm or more in view of its manufacture and handling, mechanical strength and so forth.

-Photoconductive Layer-

There are no particular limitations concerning the photoconductive layer in the electrophotographic photosensitive member of the present invention. It may preferably be one having sensitivity to the light of 380 to 500 nm in wavelength. It is constituted primarily of a part in an amorphous state, and may include a polycrystalline or microcrystalline part as long as the intended properties are obtainable.

As a material for the photoconductive layer having sensitivity to the light having such wavelength, it may preferably comprise an amorphous material composed chiefly of silicon atoms. Also, in order to improve photoconductivity and charge retentivity, the photoconductive layer may be incorporated with hydrogen atoms and optionally halogen atoms.

The hydrogen atoms and halogen atoms in the photoconductive layer bond to unused bonding valences of silicon atoms and can improve layer quality, in particular, can improve photoconductivity and charge retentivity. There are no particular limitations on the content of hydrogen atoms. It may appropriately be changed according to wavelengths of exposure systems. For example, the hydrogen atoms may be in a content of, e.g., 10 to 40 atm % based on the total of silicon atoms and hydrogen atoms. In regard to the shape of distribution of hydrogen atoms, it may appropriately be controlled according to wavelengths of exposure systems. In particular, it is known that the presence of hydrogen atoms and halogen atoms in a large content to a certain extent makes optical band gaps large and shifts the peak of sensitivity to the short-wavelength side. In order to improve sensitivity to the light of 380 to 500 nm in wavelength, the hydrogen atoms may preferably be in a content of 15 atm % or more based on the total of silicon atoms and hydrogen atoms.

In addition, the photoconductive layer may preferably be incorporated with atoms capable of controlling its conductivity, standing distributed non-uniformly in the layer thickness direction. This is to control or compensate the mobility of carriers of the photoconductive layer so as to be balances in a high level, to thereby achieve improvement in chargeability, reduction in photomemory and improvement in sensitivity.

The atoms capable of controlling conductivity may be so contained that the content of the atoms per unit length in the layer thickness direction of the photoconductive layer changes continuously or stepwise, or may be contained in such a state that the content of the atoms per unit length in the layer thickness direction does not change over a given length in the thickness direction while changing in the layer thickness direction. The atoms capable of controlling conductivity may include what is called impurities, used in the field of semiconductors, and the following is usable therefore: atoms belonging to Group 13 of the periodic table (also simply "Group 13 atoms") or atoms belonging to Group 15 of the periodic table (also simply "Group 14 atoms"). The Group 13 atoms may specifically include boron (B), aluminum (Al), gallium (Ga), indium (In) and thallium (Tl). In particular, B, Al and Ga are preferred. The Group 15 atoms may specifically include nitrogen (N), phosphorus (P), arsenic (As), antimony (Sb) and bismuth (Bi). In particular, P, As and Sb are preferred. The atoms capable of controlling conductivity, incorporated in the photoconductive layer, may be in a content of, but not particularly limited to, usually from 0.05 to 5 atm ppm. Also, in the range in which the image exposure light arrives, the photoconductive layer may contain substantially no atoms capable of controlling conductivity.

The photoconductive layer may also appropriately contain, besides the foregoing, helium atoms, hydrogen atoms and so forth in view of controllability of physical properties and in view of manufacture.

The layer thickness of the photoconductive layer may appropriately be determined as desired from the viewpoints of the desired electrophotographic properties to be obtained, the efficiency and economical advantages in manufacture, and so forth. For example, the photoconductive layer may be formed in a thickness of from 5 to 50 μm, preferably from 10 to 45 μm, and more preferably from 20 to 40 μm. As long as the layer thickness is 5 μm or more, the electrophotographic properties such as chargeability and sensitivity can be sufficient in practical use. As long as the layer thickness is 50 μm or less, the photoconductive layer can be formed in a good efficiency.

Such a photoconductive layer may be formed on the substrate by, e.g., glow discharging. Such glow discharging may include a process making use of a high-frequency plasma-assisted CVD system described later. For example, it may include a process in which an Si-feeding source gas capable of feeding silicon atoms (Si), an H-feeding source gas capable of feeding hydrogen atoms (H) and optionally an X-feeding source gas capable of feeding halogen atoms (X) may be introduced in the desired gaseous state into a reactor whose inside can be evacuated, and glow discharge may be caused to take place in the reactor so that a film composed of a-Si:H,X can be formed on the substrate previously set at a stated position.

The material that can serve as Si-feeding gases may include gaseous or gasifiable silicon hydrides (silanes) such as $SiH_4$, $Si_2H_6$, $Si_3H_8$ and $Si_4H_{10}$. Further, in view of easiness of handling in layer formation, good Si-feeding efficiency and so forth, the material may include $SiH_4$ and $Si_2H_6$ as preferred ones. In addition, any of these gases may be used alone, or mixed in a stated mixing ratio.

Then, taking into account the controllability of film physical properties, convenience for gas feeding, and so forth, any of these gases may further be mixed with at least one gas selected from $H_2$, He and silicon compounds containing hydrogen atoms, in a desired quantity.

The source gas for feeding halogen atoms may specifically include, as preferred ones, fluorine gas ($F_2$) and interhalogen compounds such as BrF, ClF, $ClF_3$, $BrF_3$, $BrF_5$, $IF_3$ and $IF_7$, and silicon fluorides such as $SiF_4$ and $Si_2F_6$. In order to control the quantity of the halogen atoms to be incorporated in the photoconductive layer, for example the temperature of the substrate, the quantity in which source materials used to incorporate the halogen atoms are introduced into the reactor, the pressure in a discharge space, the discharge power and so forth may be controlled.

As for source materials for introducing the atoms capable of controlling the conductivity of the photoconductive layer, a source material for incorporating the Group 13 atoms may specifically include, as a material for incorporating boron atoms, boron hydrides such as $B_2H_6$, $B_4H_{10}$, $B_5H_9$, $B_5H_{11}$, $B_6H_{10}$, $B_6H_{12}$ and $B_6H_{14}$, and boron halides such as $BF_3$, $BCl_3$ and $Br_3$. Besides, the material may also include $AlCl_3$, $GaCl_3$, $Ga(CH_3)_3$, $InCl_3$ and $TlCl_3$. A source material for incorporating Group 15 atoms may include, as a material for incorporating phosphorus atoms, phosphorus hydrides such as $PH_3$ and $P_2H_4$ and phosphorus halides such as $PH_4I$, $PF_3$, $PF_5$, $PCl_5$, $PBr_3$, $PBr_5$ and $PI_3$. Besides, the source material for incorporating Group 15 atoms may also include $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BiBr_3$. These source materials for incorporating the atoms capable of controlling the conductivity may be used optionally after diluted with $H_2$ and/or He.

In order that a photoconductive layer having the desired film properties is formed using these source gases, the mixing proportion of the gases for feeding Si, halogen, etc. to the dilute gas, the gas pressure inside the reactor, the discharge power and the substrate temperature may appropriately be set. The flow rate of $H_2$ and/or He that may be used as dilute gas may appropriately be selected within an optimum range in accordance with layer designing, and may be within the range of, e.g., from 3 to 30 times, preferably from 4 to 15 times, and more preferably from 5 to 10 times, as much as the Si-feeding gas. The gas pressure inside the reactor also may appropriately be selected within an optimum range in accordance with layer designing, and set at, e.g., from $1\times10^{-2}$ to $1\times10^{3}$ Pa, preferably from $5\times10^{-2}$ to $5\times10^{2}$ Pa, and more preferably from $1\times10^{-1}$ to $2\times10^{2}$ Pa. The discharge power also may appropriately be selected within an optimum range in accordance with layer designing, where the ratio of the discharge power to the flow rate of Si-feeding gas may preferably be set in the range of from 0.5 to 8, and preferably from 2 to 6. Further, the temperature of the substrate alos may appropriately be selected within an optimum range in accordance with layer designing, and set at, e.g., from 200 to 350° C., preferably from 210 to 330° C., and more preferably from 220 to 300° C.

As desirable ranges of numerical values of the substrate temperature, the gas pressure and so forth for forming the photoconductive layer, the above ranges may be cited. Usually, however, conditions can not independently and separately be determined. It is preferable to determine optimum values on the basis of mutual and systematic relationship so that the photoconductive layer having the desired properties can be formed.

-Surface Layer-

The surface layer in the electrophotographic photosensitive member of the present invention is provided in order to provide the photosensitive member with a high light-transmitting property chiefly for short-wavelength light such as the light of 380 to 500 nm in wavelength, service environmental resistance such as resistance to continuous repeated use and moisture resistance, and good properties in regard to electrical properties such as high resolution.

The surface layer in the present invention may have a function also as a charge retention layer in the case of a photosensitive member for electrophotographic apparatus of a positive charging system, and may have a function as a charge retention layer in itself in the case of a positive-charging photosensitive member. However, the upper-part charge injection blocking layer described later may be made to have the function of charge retention so as to secure the degree of freedom of compositional designing of the surface layer.

As for the material for the surface layer in the present invention, the surface layer includes the amorphous material composed chiefly of silicon atoms and nitrogen atoms and containing at least oxygen atoms and/or carbon atoms, and the amorphous material contains oxygen atoms, carbon atoms and nitrogen atoms in average concentrations represented respectively by the expressions (1) to (3):

$$0.0001 \leqq O/(Si+N+O+C) \leqq 0.2 \quad (1)$$

$$0.0001 \leqq C/(Si+N+O+C) \leqq 0.1 \quad (2)$$

$$0.3 \leqq N/(Si+N+O+C) \leqq 0.6 \quad (3)$$

(in the expressions (1) to (3), Si represents the number of silicon atoms, N represents the number of nitrogen atoms, O represents the number of oxygen atoms, and C represents the number of carbon atoms). The surface layer may chiefly be constituted of a part in an amorphous state, and may include a polycrystalline or microcrystalline part as long as the intended properties are obtainable. In the amorphous material contained in the surface layer, the material "composed chiefly of silicon atoms and nitrogen atoms" refers to one containing silicon atoms and nitrogen atoms as main components, in which all the part other than oxygen atoms and carbon atoms may be composed of silicon atoms and nitrogen atoms.

The nitrogen atoms in such an amorphous material may be in the content in the range represented by the expression (3) as an average concentration, where a uniform surface layer can be formed, a good yield can be secured in production, and almost no image exposure light is absorbed. It is preferable that the nitrogen atoms are in an average concentration within the range represented by $0.35 \leqq N/(Si+N+O+C) \leqq 0.55$, because the above effect is more remarkably obtainable.

The oxygen atoms in the surface layer may be in the content within the range represented by the expression (1) as an average concentration:

$$0.0001 \leqq O/(Si+N+O+C) \leqq 0.2 \quad (1)$$

(wherein N represents the number of nitrogen atoms, Si represents the number of silicon atoms, O represents the number of oxygen atoms, and C represents the number of carbon atoms) in the amorphous material contained in the surface layer, where almost no imagewise exposure light of 380 to 500 nm in wavelength is absorbed. The oxygen atoms may be in a content within the range represented by $0.005 \leqq O/(Si+N+O+C) \leqq 0.1$, where the above effect is more remarkably obtainable. The electrophotographic photosensitive member having the surface layer containing oxygen atoms in the above range has superior electrophotographic properties while sufficiently keeping the short-wavelength light transmitting property. More specifically, it can be commonly said that wide-bandgap semiconductors such as a-SiN:H tend to have many defect levels in gaps to make it difficult to lessen the defects. The defects due to dangling bonds present in the surface layer are known to have bad influences upon the properties required as photosensitive members for electrophotographic apparatus. As the bad influences resulting from dangling bonds, the following may be cited: an afterimage phenomenon (photomemory) occurring in repeated use due to the entrapment of electric charges in the defects present in the surface layer, and a lowering in resolution because of sideway flow of electric charges. However, the presence of the oxygen atoms in such content enables such bad influences to be cancelled.

The carbon atoms in the surface layer may be in the content within the range represented by the expression (1) as an average concentration:

$$0.0001 \leqq C/(Si+N+O+C) \leqq 0.1 \quad (2)$$

(wherein N represents the number of nitrogen atoms, Si represents the number of silicon atoms, O represents the number of oxygen atoms, and C represents the number of carbon atoms), where the structural relaxation can be promoted while the imagewise exposure light of 380 to 500 nm in wavelength is kept form being absorbed. The carbon atoms may be in a content within a range represented by $0.005 \leqq C/(Si+N+O+C) \leqq 0.05$, where the above effect is more remarkably obtainable. The electrophotographic photosensitive member having the surface layer containing the carbon atoms in the above range has superior electrophotographic properties while sufficiently keeping the short-wavelength light transmitting property.

The nitrogen atoms and the oxygen atoms may also be uniformly present in the surface layer. It is more preferable for them to be so contained as to have gradient compositional distribution in which nitrogen atoms are in a higher concentration on the surface side and the concentration of nitrogen atoms decreases toward the photoconductive layer side. Such a change in the distribution may be linear, or may be of an exponential function, or may be of a composition which changes stepwise. What is preferred is a state in which the concentration of nitrogen atoms increases toward the surface side as a whole. In particular, where the change is of an exponential function, the smooth movement of electric charges and the relaxation of bonds are considered to take place, which is preferable because best electrophotographic properties are secured. It is further preferable that the surface layer contains nitrogen atoms and oxygen atoms in such a way that the value of O/N which is the ratio of the number O of oxygen atoms contained per unit length in the thickness direction to the number N of nitrogen atoms contained per unit length in the thickness direction increases toward the open surface. Where the number N of nitrogen atoms contained per unit length in the thickness direction increases gradually, it is preferable that the rate of an increase in the number O of oxygen atoms is always larger than the number N of nitrogen atoms contained per unit length in the thickness direction. An increase in the number of nitrogen atoms contained per unit length in the thickness direction brings about an increase in the strain of bonds. However, inasmuch as the number of oxygen atoms is always larger than the number of nitrogen atoms, it is considerd that probably the oxygen atoms relax the strain of bonds and the relaxation of strain of bonds is ideally effected.

Such a surface layer may be incorporated with other atoms. Such atoms may be hydrogen atoms and/or halogen atoms, which are preferable because they bond to unused bonding valences of silicon atoms and can improve layer quality, in particular, can improve photoconductive properties and charge retentivity. The hydrogen atoms may be in a content of, e.g., from 5 to 70 atm %, preferably from 8 to 60 atm %, and more preferably from 10 to 50 atm %, as an average value in the film based on the total content of constituent atoms.

The surface layer may optionally be further incorporated with atoms capable of controlling its conductivity, such as Group 13 atoms and Group 15 atoms. The atoms capable of controlling conductivity may be contained all over the surface layer in a uniformly distributed state, or may be contained partly in such a state that they are distributed non-uniformly in the layer thickness direction in terms of the number of atoms contained per unit length in the thickness direction. The atoms capable of controlling conductivity, incorporated in the surface layer, may preferably be in a content of, e.g., from $1\times10^{-3}$ to $1\times10^{3}$ atom ppm, preferably from $1\times10^{-2}$ to $5\times10^{2}$ atom ppm, and more preferably from $1\times10^{-1}$ to $1\times10^{2}$ atom ppm.

The surface layer may have a layer thickness of, e.g., from 0.01 to 3 μm, preferably from 0.05 to 2 μm, and more preferably from 0.1 to 1 μm. As long as it has a layer thickness of 0.01 μm or more, the surface layer is by no means lost because of wear and the like. As long as it has a layer thickness of 3 μm or less, a lowering in electrophotographic properties, e.g., an increase in residual potential is kept from occurring.

A region in which the content of nitrogen atoms changes so as to decrease toward the photoconductive layer may also be provided between the surface layer and the photoconductive layer. This can bring about an improvement in adherence between the surface layer and the photoconductive layer, can smooth the movement of carriers to the surface, and also can further reduce the influence of interference due to the reflection of light at the interface between the photoconductive layer and the surface layer.

Such a surface layer may be formed on the photoconductive layer by, e.g., glow discharging. To form, by such glow discharging, the surface layer composed of such an a-SiN type material, basically an Si-feeding source gas capable of feeding silicon atoms (Si), an N-feeding source gas capable of feeding nitrogen atoms (N), an O-feeding source gas capable of feeding oxygen atoms (O), a C-feeding source gas capable of feeding carbon atoms (C), an H-feeding source gas capable of feeding hydrogen atoms (H) and/or a source gas capable of feeding halogen atoms (F) may be introduced in the desired gaseous state into a reactor whose inside can be evacuated, and glow discharge may be brought about in the reactor so that a film which contains amorphous silicon, nitrogen atoms, oxygen atoms, carbon atoms and so forth can be formed on the substrate previously set at a stated position.

The material that can serve as gases for feeding silicon (Si), used to form the surface layer, may include gaseous or gasifiable silicon hydrides (silanes) such as $SiH_4$, $Si_2H_6$, $Si_3H_8$ and $Si_4H_{10}$. Further, in view of easiness of handling in layer formation and good Si-feeding efficiency, the material may include $SiH_4$ and $Si_2H_6$ as preferred ones. These Si-feeding source gases may be used optionally after diluted with a gas such as $H_2$, He, Ar or Ne.

The materials that can serve as gases for feeding nitrogen atoms, oxygen atoms and carbon atoms may include gaseous or gasifiable compounds such as $N_2$, $NH_3$, NO, $N_2O$, $NO_2$, $O_2$, CO, $CO_2$, $CH_4$, $C_2H_2$, $C_2H_4$, $C_2H_6$, $C_3H_8$ and $C_4H_{10}$. In particular, as the gas for feeding nitrogen atoms, $N_2$ is preferred because it provides best properties. Also, as the gas for feeding oxygen atoms, NO is preferred, and as that for feeding carbon atoms, $CH_4$ is preferred. CO and $CO_2$ are also preferred in view of such an advantage that oxygen atoms and carbon atoms can simultaneously be fed. These source gases for feeding nitrogen atoms and oxygen atoms may be used optionally after diluted with a gas such as $H_2$, He, Ar or Ne. Especially when oxygen and carbon are added in slight quantities, for example, NO gas and $CO_2$ gas may be fed after diluted with $H_2$ gas or He gas. This is very important because their flow rates can accurately be controlled and, in addition, these oxygen-feeding gas and carbon-feeding gas can easily be incorporated into the film even when added in slight quantities.

The source gas for feeding halogen atoms may include, as source gas for feeding fluorine atoms, fluorine gas ($F_2$) and interhalogen compounds such as BrF, ClF, $ClF_3$, $BrF_3$, $BrF_5$, $IF_3$ and $IF_7$, and silicon fluorides such as $SiF_4$ and $Si_2F_6$.

In order to form the surface layer using these source gases, the substrate temperature, the gas pressure inside the reactor, and so forth may appropriately be set. The substrate temperature may appropriately be selected within an optimum range in accordance with layer designing, and may be set at, e.g., from 200 to 350° C., preferably from 230 to 330° C., and more preferably from 250 to 300° C. The gas pressure inside the reactor may likewise appropriately be selected within an optimum range in accordance with layer designing, and may preferably be set at, e.g., from $1\times10^{-2}$ to $2\times10^{3}$ Pa, preferably from $5\times10^{-1}$ to $5\times10^{2}$ Pa, and more preferably from $1\times10^{1}$ to $1\times10^{2}$ Pa.

The discharge power may be from 10 W to 5,000 W, and, in terms of power per unit area of a cathode electrode, from 2 mW/cm$^2$ to 1.4 mW/cm$^2$, as preferable ranges. In particular, in order that an a-SiN type film having a good transmittance is obtained by materializing the above range of the nitrogen atom content, it is preferable to bring the silicon-containing gas flow rate FSi [unit: ml/min(normal: standard condition)], the nitrogen-containing gas flow rate FN [unit: ml/min(normal)] and the discharge power (unit: W) into an appropriate relation. More specifically, it is preferable that the value of $PW\cdot FN/(FSi)^2$, which is the product of the power per unit gas quantity, in particular, the power with respect to the unit gas quantity of silicon-containing gas (PW/FSi) by the gas concentration ratio of nitrogen-containing gas to silicon-containing gas (FN/FSi), is from 50 W min/ml(normal) or more to 300 W min/ml (normal) or less, and more preferably from 80 W min/ml (normal) or more to 200 W min/ml (normal) or less. When that value is set to be in this range, the optical band gap of the film is brought to about 2.8 eV and also the coefficient of absorption is brought to 3,000 $cm^{-1}$ or less. As long as the product of the electric power and the flow rate is 50 or more, the light of 380 to 500 nm in wavelength is kept from being absorbed, and the transmittance of such wavelength light is improved. Also, as long as this value is 300 or less, the hardness of the film is kept from lowering. The reason therefor is considered to be that the introduction of damages resulting from plasma during film formation is reduced.

The reason why the above range is preferable is unclear, but is considered as stated below. In order to obtain the desired film, the radicals of a source material which are present in plasma must appropriately be balanced. The concentration of radicals at the time the source gases have been decomposed is considered to depend on the source gas concentration ratio and the electric power when a plurality of source gases are used. However, since there are differences in decomposition efficiency according to gas species, it is considered that the concentration of radicals is kept within an appropriate range when the product of the power with respect to the unit gas quantity of silicon-containing gas (PW/FSi) by the gas concentration ratio of nitrogen-containing gas to silicon-containing gas (FN/FSi) is within the above range.

In order for the surface layer to be incorporated with oxygen atoms and carbon atoms and to have the gradient composition in which their concentrations increase toward the open surface as described above, the O-feeding source gas and the C-feeding source gas may be fed under the appropriate control of the conditions for deposited-film formation as exemplified by gas concentration, high-frequency power and substrate temperature while the amorphous film is formed feeding the O-feeding source gas and the C-feeding source gas. Where such source gases are in a very small quantity, they may be diluted with He gas or the like so that they can be fed into the reactor under the accurate control of flow rates through a mass flow controller. The oxygen atoms and carbon atoms are easily incorporated into the film by only adding their source gases in a very small quantity, and hence gas cylinders may be used having the source gases appropriately diluted with a dilute gas to, e.g., approximately from 100 ppm to 20%, to thereby improve controllability.

In the present invention, as desirable ranges of numerical values of the substrate temperature, the gas pressure and so forth for forming the surface layer, the above ranges may be cited. Usually, however, the conditions can not independently separately be determined. It is preferable to determine optimum values on the basis of mutual and systematic relevance so that the photosensitive member having the desired properties can be formed.

-Upper-Part Charge Injection Blocking Layer-

Where the charging of the photosensitive member is negative charging, the upper-part charge injection blocking layer 105 provided in the electrophotographic photosensitive member of the present invention prevents electric charges from entering from the upper part (i.e., from the surface layer side) to bring about an improvement in chargeability of the surface layer.

The material for the upper-part charge injection blocking layer may be an amorphous material composed chiefly of silicon atoms and nitrogen atoms. The material "composed chiefly of silicon atoms and nitrogen atoms" refers to one containing silicon atoms and nitrogen atoms as main components, and all the part excluding Group 13 elements may be composed of silicon atoms and nitrogen atoms.

The nitrogen atoms in the amorphous material included in the upper-part charge injection blocking layer may be contained in an average concentration represented respectively by the expression (6):

$$0.05 \leqq N/(Si+N) \leqq 0.35 \quad (6)$$

(wherein Si represents the number of silicon atoms and N represents the number of nitrogen atoms). This is preferable because the light of 380 to 500 nm in wavelength can be kept from being absorbed, and is more preferably be $0.1 \leqq N/(Si+N) \leqq 0.3$, and more preferably be $0.15 \leqq N/(Si+N) \leqq 0.3$. The silicon atoms and nitrogen atoms contained in the upper-part charge injection blocking layer may uniformly be distributed all over the layer, or may non-uniformly be distributed in the layer thickness direction, e.g., may be so distributed as to have composition gradient from the photoconductive layer side to the surface layer, in order to improve adherence and prevent interference. In any case, however, they should evenly be contained in uniform distribution in the plane parallel to the surface of the substrate. This is preferable also in view of the achievement of in-plane uniform properties.

The amorphous material composed chiefly of silicon atoms and nitrogen atoms which constitute the upper-part charge injection blocking layer may preferably be incorporated with a periodic-table Group 13 element for the purpose of charge retention of the surface layer and in order to provide p-type conductivity. Such a periodic-table Group 13 element may specifically include boron (B), aluminum (Al), gallium (Ga), indium (In) and thallium (Tl). In particular, boron is preferred.

The periodic-table Group 13 element contained in the amorphous material constituting the upper-part charge injection blocking layer may uniformly be distributed all over the upper-part charge injection blocking layer or may non-uniformly be distributed in the layer thickness direction. In any case, however, it should evenly be contained in uniform distribution in the plane parallel to the surface of the substrate. This is preferable also in view of the achievement of in-plane uniform properties.

The periodic-table Group 13 element contained in the amorphous material constituting the upper-part charge injection blocking layer may preferably be in a content ranging from 50 atm ppm or more to 3,000 atm ppm or less, and more preferably from 100 atm ppm or more to 2,000 atm ppm or less, based on the total content of constituent atoms.

The material for the upper-part charge injection blocking layer may also be an amorphous material composed chiefly of silicon atoms and carbon atoms. The material "composed chiefly of silicon atoms and carbon atoms" refers to one containing silicon atoms and carbon atoms as main components, and all the part excluding periodic-table Group 13 elements may be composed of silicon atoms and carbon atoms.

The carbon atoms in the amorphous material contained in the upper-part charge injection blocking layer may be in an average concentration represented by the expression (4):

$$0.1 \leqq C/(Si+C) \leqq 0.5 \quad (4)$$

(wherein Si represents the number of silicon atoms and C represents the number of carbon atoms). This is preferable because the light of 380 to 500 nm in wavelength can be kept from being absorbed, and is more preferably be $0.15 \leqq C/(Si+C) \leqq 0.4$. The silicon atoms and carbon atoms contained in the upper-part charge injection blocking layer may uniformly be distributed all over the layer, or may non-uniformly be distributed in the layer thickness direction, e.g., may be so distributed as to have composition gradient from the photoconductive layer side to the surface layer, in order to improve adherence and prevent interference. In any case, however, they should evenly be contained in uniform distribution in the plane parallel to the surface of the substrate. This is preferable also in view of the achievement of in-plane uniform properties.

The amorphous material composed chiefly of silicon atoms and carbon atoms which constitutes the upper-part charge injection blocking layer may preferably be incorporated with a periodic-table Group 13 element for the purpose of charge retention of the surface layer and in order to provide p-type conductivity. Such a periodic-table Group 13 element may specifically include boron (B), aluminum (Al), gallium (Ga), indium (In) and thallium (Tl). In particular, boron is preferred.

The periodic-table Group 13 element contained in the amorphous material constituting the upper-part charge injection blocking layer may uniformly be distributed all over the upper-part charge injection blocking layer or may non-uniformly be distributed in the layer thickness direction. In any case, however, it should evenly be contained in uniform distribution in the plane parallel to the surface of the substrate. This is preferable also in view of the achievement of in-plane uniform properties.

The amorphous material constituting the upper-part charge injection blocking layer may preferably contain a periodic-table Group 13 element in an average concentration represented by the expression (5):

$$50\times10^{-6} \leqq X/Si \leqq 3{,}000\times10^{-6} \quad (5)$$

(wherein X represents the number of periodic-table Group 13 element and Si represents the number of silicon atoms), and more preferably $100\times10^{-6} \leqq X/Si \leqq 2{,}000\times10^{-6}$. Also, in the present invention, the amorphous material constituting the upper-part charge injection blocking layer may preferably be incorporated with hydrogen atoms. The hydrogen atoms bond to unused bonding valences of silicon atoms and can improve layer quality, in particular, can improve photoconductive properties and charge retentivity. The hydrogen atoms may be in a content of from 30 atm ppm or more to 70 atm ppm or less, preferably from 35 atm ppm or more to 65 atm ppm or less, and more preferably from 40 atm ppm or more to 60 atm ppm or less.

In the present invention, the upper-part charge injection blocking layer may have a layer thickness of, e.g., from 5 nm or more to 1,000 nm or less, preferably from 10 nm or more to 800 nm or less, and more preferably from 15 nm or more to 500 nm or less, in view of the desired electrophotographic properties to be obtained, economical effects and so forth. As long as it has a layer thickness of 5 nm or more, it can have a sufficient ability to block the charge injection from the surface side. As long as it has a layer thickness of 1,000 nm or less, it can achieve an improvement in electrophotographic properties.

It is also preferable for the upper-part charge injection blocking layer 106 to be made to change continuously in composition from the photoconductive layer 103 side to the surface layer 104. This is effective in improving adherence and preventing interference.

To form an upper-part charge injection blocking layer having properties that can achieve the object of the present invention, it is preferable that the mixing proportion of the gas for feeding silicon atoms to the gas for feeding nitrogen atoms, the gas pressure inside the reactor, the discharge power and the substrate temperature are appropriately set. The pressure inside the reactor may also appropriately be selected within an optimum range in accordance with layer designing, and may be set at, e.g., from $1\times10^{-2}$ Pa or more to $1\times10^{3}$ Pa or less, preferably from $5\times10^{-2}$ Pa or more to $5\times10^{2}$ Pa or less, and more preferably from $1\times10^{-1}$ Pa or more to $1\times10^{2}$ Pa or less. Further, the substrate temperature may also appropriately be selected within an optimum range in accordance with layer designing, and may preferably be set at, e.g., from 150° C. or more to 350° C. or less, more preferably from 180° C. or more to 330° C. or less, and still more preferably from 200° C. or more to 300° C. or less.

-Lower-Part Charge Injection Blocking Layer-

In the electrophotographic photosensitive member of the present invention, as shown in FIGS. 1B to 1D, a lower-part charge injection blocking layer 104 having a function to block out the injection of electric charges from the substrate 101 side may preferably be provided above the photoconductive layer 101. The lower-part charge injection blocking layer has a function to prevent electric charges from being injected from the substrate 101 side into the photoconductive layer side when the photoconductive layer 102 is subjected to charging in a certain polarity on the open surface.

The material for the lower-part charge injection blocking layer may preferably be an amorphous material composed chiefly of silicon atoms. Such an amorphous material may preferably be incorporated with impurities capable of controlling conductivity, in a relatively larger content than those in the photoconductive layer. In the case of a positive-charging electrophotographic photosensitive member, a periodic-table Group 13 element may be used as an impurity element to be contained in the lower-part charge injection blocking layer. In the case of a negative-charging electrophotographic photosensitive member, a periodic-table Group 15 element may be used as an impurity element to be contained in the lower-part charge injection blocking layer. The impurity element to be contained in the lower-part charge injection blocking layer may appropriately be determined as desired so that the object of the present invention can effectively be achieved. It may preferably be in a content of from 10 atm ppm or more to 10,000 atm ppm or less, more preferably from 50 atm ppm or more to 7,000 atm ppm or less, and still more preferably from 100 atm ppm or more to 5,000 atm ppm or less, based on the total content of constituent atoms in the lower-part charge injection blocking layer.

The lower-part charge injection blocking layer may further be incorporated with nitrogen atoms and oxygen atoms to improve the adherence between the lower-part charge injection blocking layer and the substrate 101. Also, in the case of the negative-charging electrophotographic photosensitive member, the lower-part charge injection blocking layer may optimally be incorporated with nitrogen atoms and oxygen atoms without being doped with the impurity element, whereby a superior charge injection blocking ability can be attained. In order to improve the charge injection blocking ability, nitrogen atoms and oxygen atoms incorporated in the whole layer region of the lower-part charge injection blocking layer may preferably be in a content, as the sum of the number of nitrogen atoms and oxygen atoms, of from 0.1 atm % or more to 40 atm % or less, and more preferably from 1.2 atm % or more to 20 atm % or less, based on the total content of constituent atoms in the lower-part charge injection blocking layer.

The lower-part charge injection blocking layer may also preferably be incorporated with hydrogen atoms. In such a case, the hydrogen atoms incorporated bond to unused bonding valences present in the layer and are effective in improving layer quality. The hydrogen atoms incorporated in the lower-part charge injection blocking layer may preferably be in a content of from 1 atm % or more to 50 atm % or less, more preferably from 5 atm % or more to 40 atm % or less, and sill more preferably from 10 atm % or more to 30 atm % or less, based on the total content of constituent atoms in the lower-part charge injection blocking layer.

The lower-part charge injection blocking layer may preferably have a layer thickness of from 100 nm or more to 5,000 nm or less, more preferably from 300 nm or more to 4,000 nm or less, and still more preferably from 500 nm or more to 3,000 nm or less, in view of the desired electrophotographic properties to be obtained, economical effects and so forth. As long as it has a layer thickness of from 100 nm or more to 5,000 nm or less, it can have a sufficient ability to block the charge injection from the substrate 101, can attain a sufficient chargeability, also can be expected to be improved in electrophotographic properties, and may raise no problems such as a rise in residual potential.

To form the lower-part charge injection blocking layer, it is necessary to appropriately set the gas pressure inside the reactor, the discharge power and the substrate temperature. Conductive-substrate temperature (Ts) may appropriately be selected within an optimum range in accordance with layer designing, and may preferably be set at from 150° C. or more to 350° C. or less, more preferably from 180° C. or more to 330° C. or less, and still more preferably from 200° C. or more to 300° C. or less. The gas pressure inside the reactor may also appropriately be selected within an optimum range in accordance with layer designing, and may be set at, e.g., from $1\times10^{-2}$ Pa or more to $1\times10^{3}$ Pa or less, preferably from $5\times10^{-2}$ Pa or more to $5\times10^{2}$ Pa or less, and more preferably from $1\times10^{-1}$ Pa or more to $2\times10^{2}$ Pa or less.

-Electrophotographic Photosensitive Member Production Apparatus-

Apparatus and manufacturing process for producing the electrophotographic photosensitive member of the present invention are described below.

Figure 2:
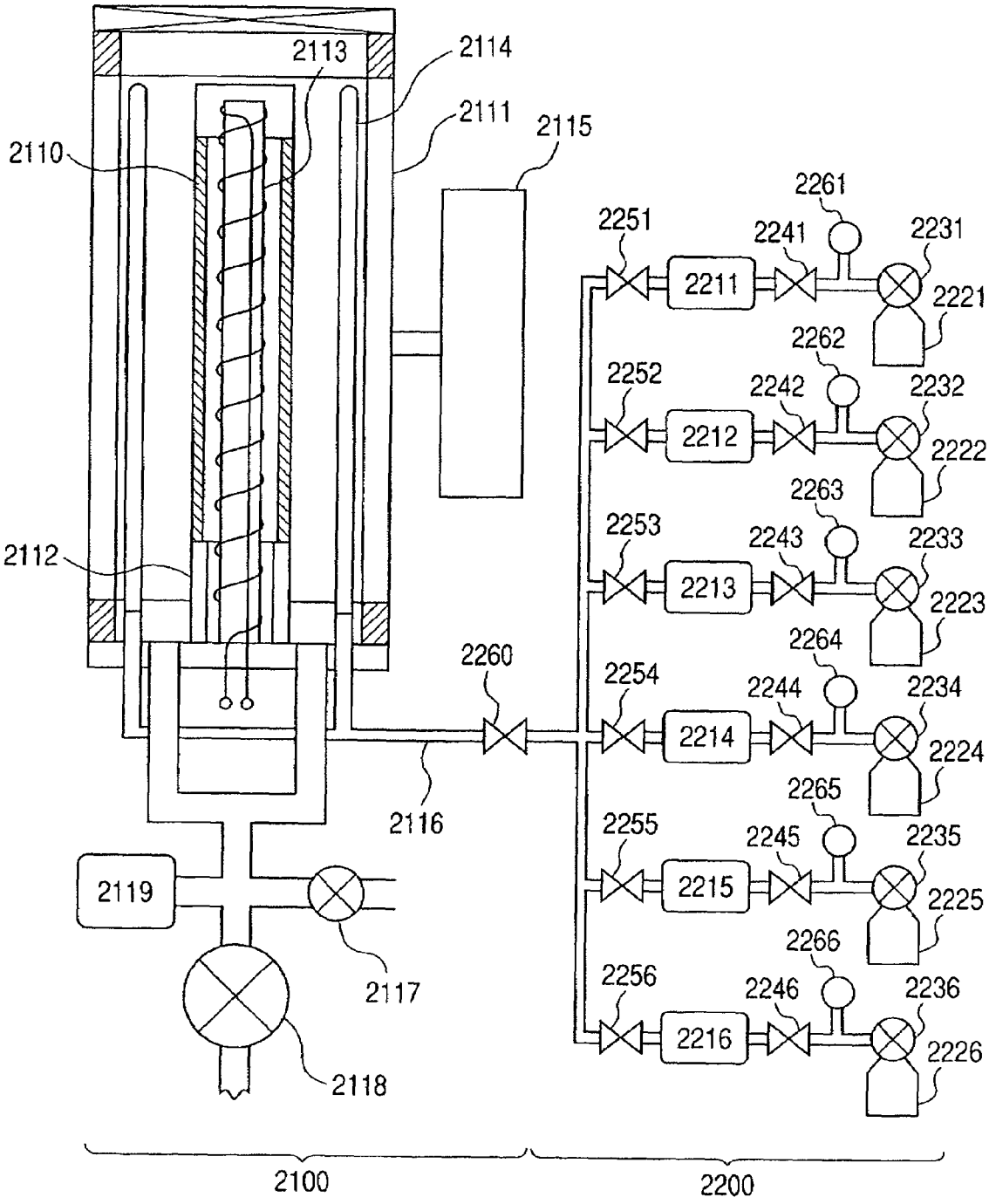
FIG. 2 is a schematic diagrammatic view showing an example of a plasma-assisted CVD (chemical vapor deposition) system which uses a RF band high frequency, and is used in producing the electrophotographic photosensitive member of the present invention.

The electrophotographic photosensitive member of the present invention may be obtained by forming the photoconductive layer and the surface layer on the substrate by means of a high-frequency plasma-assisted CVD system. As an example thereof used to produce the electrophotographic photosensitive member of the present invention, an apparatus for producing the electrophotographic photosensitive member by high-frequency plasma-assisted CVD using RF bands as power source frequency (hereinafter also refrred to simply as "RF-PCVD") is constituted chiefly of a deposition system 2100, a source gas feed system 2200 and an exhaust system (not shown) for evacuating the inside of a reactor 2111, as shown in FIG. 2. In the reactor 2111 in the deposition system 2100, a stand 2112 on which a cylindrical substrate 2110 is mounted, a heater 2113 for heating the substrate, and a source gas feed pipe 2114 are provided. A high-frequency matching box 2115 is also connected to the reactor.

The source gas feed system 2200 is constituted of gas cylinders 2221 to 2226 for source gases, valves 2231 to 2236, 2241 to 2246 and 2251 to 2256, and mass flow controllers 2211 to 2216. The gas cylinders for the respective source gases are connected to the gas feed pipe 2114 in the reactor 2111 through an auxiliary valve 2260.

Using this apparatus, deposited films can be formed, e.g., in the following way.

First, the cylindrical substrate 2110 is set on the stand 2112 in the reactor 2111, and the inside of the reactor 2111 is evacuated by means of an exhaust device (e.g., a vacuum pump, not shown). Subsequently, the temperature of the cylindrical substrate 2110 is controlled at a given temperature of from 150° C. to 350° C. by means of the heater 2113 for heating the substrate.

To flow source gases for forming deposited films into the reactor 2111, gas cylinder valves 2231 to 2236 and a leak valve 2117 of the reactor are checked to make sure that they are closed, and also gas flow-in valves 2241 to 2246, gas flow-out valves 2251 to 2256 and an auxiliary valve 2260 are checked to make sure that they are opened. Then, a main valve 2118 is first opened to evacuate the insides of the reactor 2111 and a source gas pipe 2116.

Next, at the time a vacuum gauge 2119 has been read to indicate a pressure of about 0.1 Pa, the auxiliary valve 2260 and the gas flow-out valves 2251 to 2256 are closed. Thereafter, gas cylinder valves 2231 to 2236 are opened to introduce respective gases from gas cylinders 2221 to 2226, and the pressure of each gas is controlled to be 0.2 MPa by operating pressure controllers 2261 to 2266. Next, the gas flow-in valves 2241 to 2246 are slowly opened to introduce respective gases into mass flow controllers 2211 to 2216.

After the film formation is thus ready to start, the respective layers are formed according to the following procedure.

At the time the cylindrical substrate 2110 has had a stated temperature, necessary flow-out valves out of valves 2251 to 2256 and the auxiliary valve 2260 are slowly opened to fed given gases into the reactor 2111 from the gas cylinders 2221 to 2226 through the source gas feed pipe 2114. Next, the mass flow controllers 2211 to 2216 are operated so that each source gas is adjusted to flow at a stated rate. In that course, the opening of the main valve 2118 is adjusted while watching the vacuum gauge 2119 so that the pressure inside the reactor 2111 comes to be a given pressure of not higher than $1\times10^{2}$ Pa. At the time the inner pressure has become stable, an RF power source (not shown) with a frequency of 13.56 MHz is set at the desired electric power, and an RF power is supplied to the inside of the reactor 2111 through the high-frequency matching box 2115 to cause glow discharge to take place. The source gases fed into the reactor are decomposed by the discharge energy thus produced, so that a given deposited film composed chiefly of silicon is formed on the cylindrical substrate 2110. After a film with a desired thickness has been formed, the supply of RF power is stopped, and the flow-out valves are closed to stop gases from flowing into the reactor. The formation of a deposited film is thus completed.

The same operation is repeated plural times, whereby a light-receiving layer with the desired multi-layer structure can be formed. When the corresponding layers are formed, needless to say, the flow-out valves other than those for necessary gases are all closed. Also, in order to prevent the corresponding gases from remaining in the reactor 2111 and in the pipe extending from the flow-out valves 2251 to 2256 to the reactor 2111, the gas flow-out valves 2251 to 2256 are closed, the auxiliary valve 2260 is opened and then the main valve 2118 is fully opened so that the inside of the system is evacuated once to a high vacuum as needed.

In order to achieve uniform film formation, it is also effective to rotate the cylindrical substrate 2110 at a given speed by means of a driving mechanism (not shown) while the films are formed.

Needless to say, the gas species and valve operations described above are changed according to the conditions under which each layer is formed.

The substrate may be heated by any means usable in vacuum, specifically including electrical resistance heat elements such as a sheathed-heater winding heater, a plate heater and a ceramic heater, heat radiation lamp heating elements such as a halogen lamp and an infrared lamp, and heating elements based on a heat exchange means employing a liquid, gas or the like as a heating medium. As surface materials of the heating means, it is possible to use are metals such as stainless steel, nickel, aluminum and copper, ceramics, heat-resistant polymer resins or the like.

Besides the foregoing, a method may be used in which a container used exclusively for heating is provided in addition to the reactor and the substrate having been heated therein is transported into the reactor in vacuo.

-Electrophotographic Apparatus-

There are no particular limitations on the electrophotographic apparatus of the present invention as long as the electrophotographic photosensitive member of the present invention can be mounted thereon.

A color electrophotographic apparatus to which the electrophotographic apparatus of the present invention is applied is described with reference to FIG. 3 schematic structural view.

Figure 3:
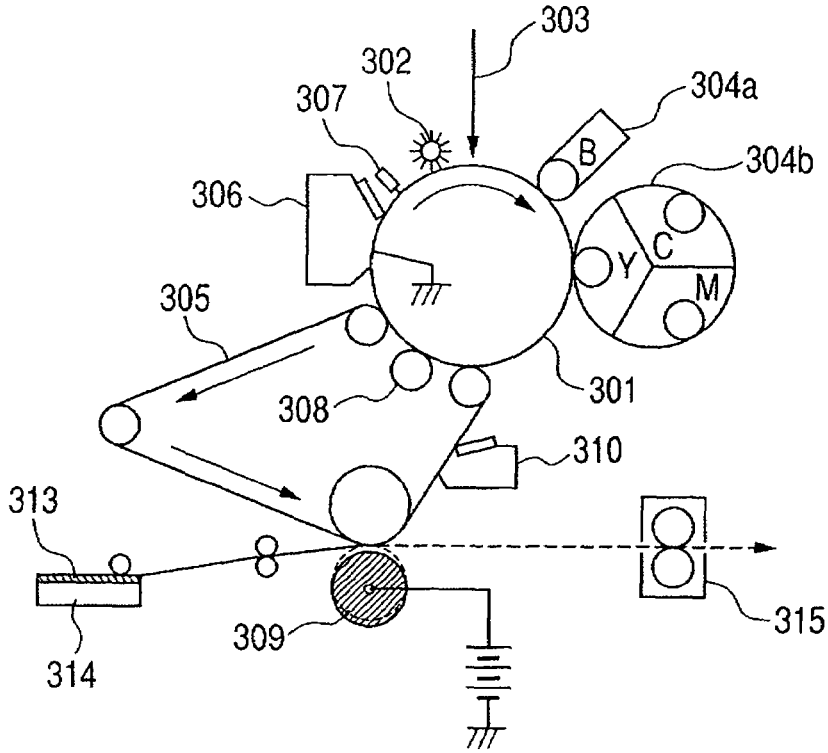
FIG. 3 is a schematic structural view showing the electrophotographic apparatus of the present invention.

The color electrophotographic apparatus shown in FIG. 3 is provided with a photosensitive drum 301 as an electrophotographic photosensitive member which includes the substrate and, superposed thereon in order, the photoconductive layer, the upper-part charge injection blocking layer and the surface layer as described above, and can be rotated by a rotating mechanism (not shown). Around the photosensitive drum 301, a primary charging assembly 302 and an image exposure unit (not shown) are disposed, the primary charging assembly 302 having a magnetic brush with which the surface of the photosensitive drum 301 is uniformly electrostatically charged to a certain polarity and potential, and the image exposure unit performing image exposure 303 on the photosensitive drum 301 thus charged to form electrostatic latent images. Around the photosensitive drum 301, the following are further disposed: a first developing assembly 304*a* which adheres a black toner B to the electrostatic latent images thus formed, as a developing assembly which performs development by adhering a toner thereto; a rotary type second developing assembly 304*b* provided therein with a developing assembly which adheres a yellow toner Y, a developing assembly which adhere a magenta toner M and a developing assembly which adheres a cyan toner C; an intermediate transfer belt 305 including a film-like dielectric belt through which toner images formed on the photosensitive drum 301 by development are transferred; a photosensitive-member cleaner 306 which cleans the surface of the photosensitive drum 301 from which the toner images have been transferred; and a charge elimination (de-charging) exposure means 307 which de-charges the photosensitive drum 301.

The intermediate transfer belt 305 is so disposed on the photosensitive drum 301 as to be driven via a contact nip zone, and is provided on its inside with a primary transfer roller 308 for transferring to the intermediate transfer belt 305 the toner images formed on the photosensitive drum 301. To the primary transfer roller 308, a bias power source (not shown) is connected which applies primary transfer bias for transferring to the intermediate transfer belt 305 the toner images held on the photosensitive drum 301. Around the intermediate transfer belt 305, a secondary transfer roller 309 for further transferring to a recording material 313 the toner images transferred to the intermediate transfer belt 305 is so provided as to come into contact with the bottom part of the intermediate transfer belt 305. To the secondary transfer roller 309, a bias power source is connected to apply secondary transfer bias for transferring to the recording material 313 the toner images held on the intermediate transfer belt 305. An intermediate transfer belt cleaner 310 is also provided to remove transfer residual toners remaining on the surface of the intermediate transfer belt 305 after the toner images on the intermediate transfer belt 305 have been transferred to the recording material 313.

This image forming apparatus is also provided with a paper feed cassette 314 which hold therein a plurality of recording materials 313 on which images are to be formed, and a transport mechanism which transports the recording material 313 from the paper feed cassette 314 via a contact nip zone formed between the intermediate transfer belt 305 and the secondary transfer roller 309. On the recording material 313 transport path, a fixing assembly 315 is disposed to fix to the recording material 313 the toner images transferred to the recording material 313.

The operation of the electrophotographic apparatus is described below.

First, as shown by arrows in FIG. 3, the photosensitive drum 301 is rotatively driven in the clockwise direction at a given peripheral speed (process speed) and the intermediate transfer belt 305 is rotatively driven in the anti-clockwise direction at the same peripheral speed as the photosensitive drum 301. The photosensitive drum 301 is, in the course of its rotation, subjected to uniform charging to a given polarity and potential by means of the primary charging assembly 302, and then subjected to the image exposure 303. Thus, an electrostatic latent image corresponding to a first-color component image (e.g., a magenta component image) of the intended color image is formed on the surface of the photosensitive drum 301. Then, the second developing assembly is rotated, and the developing assembly which adheres a magenta toner M is set at a given position, and the electrostatic latent image is developed with the first-color magenta toner M. At this stage, the first developing assembly 304*a* is kept unoperated not to act on the photosensitive drum 301, and by no means affects the first-color magenta toner image.

While passing through the nip zone between the photosensitive drum 301 and the intermediate transfer belt 305, the first-color magenta toner image thus formed and held on the photosensitive drum 301 is successively intermediately transferred to the outer peripheral surface of the intermediate transfer belt 305 by the aid of an electric field formed upon application of primary transfer bias from a bias power source (not shown) to the primary transfer roller 308.

The surface of the photosensitive drum 301 from which the first-color magenta toner image has been transferred to the intermediate transfer belt 305 is cleaned with the photosensitive-member cleaner 306. Next, on the surface of the photosensitive drum 301 thus cleaned, a second-color toner image (e.g., a cyan toner image) is formed in the same way as the formation of the first-color toner image. This second-color toner image is transferred and superimposed onto the surface of the intermediate transfer belt 305 to which the first-color toner image has been transferred. Subsequently, a third-color toner image (e.g., a yellow toner image) and a fourth-color toner image (e.g., a black toner image) are likewise successively tansferred and superimposed onto the intermediate transfer belt 305, thus a synthesized color toner image is formed which corresponds to the intended color image.

Next, the recording material 313 is fed at given timing, from the paper feed cassette 314 to the contact nip zone to be formed between the intermediate transfer belt 305 and the secondary transfer roller 309. Then the secondary transfer roller 309 is brought into contact with the intermediate transfer belt 305, and at the same time, secondary transfer bias is applied from a bias power source to the secondary transfer roller 309, where the synthesized color toner image formed by transferring onto the intermediate transfer belt 305 is transferred to the recording material 313 as a second image bearing member. After the synthesized color toner image has been transferred to the recording material 313, transfer residual toners on the intermediate transfer belt 305 are removed by means of the intermediate transfer belt cleaner 310. The recording material 313 to which the synthesized color toner image has been transferred is guided to the fixing assembly 315, where the synthesized color toner image is fixed with heating.

In the operation of this image forming apparatus, the secondary transfer roller 309 and the intermediate transfer belt cleaner 310 may be separated from the intermediate transfer belt 305 while executing the successive transfer of the first- to fourth-color toner images from the photosensitive drum 301 to the intermediate transfer belt 305.

The apparatus for color image formation by electrophotography, using such an intermediate transfer belt has characteristic features as shown below.

In the first place, the color aberration may be reduced in which the positions at which the respective-color toner images are to be formed deviate when the toner images are superimposed. Also, the toner images can be transferred from the intermediate transfer belt 305 without processing or controlling the recording material 313 (e.g., holding with a gripper, holding by attraction, and creating curvature) as shown in FIG. 3, and hence a great variety of materials are usable as the recording material 313. For example, recording materials having various thicknesses as exemplified by thin paper (40 g/$m^2$ paper) and up to thick paper (200 g/$m^2$ paper) may be selected and be used as the recording material 313. Also, regardless of widths and lengths, those having various sizes may be used as the recording material 313. Further, envelopes, post cards, labels and so forth may be used as the recording material 313. The intermediate transfer belt 305 also has so superior flexibility that the nip between the photosensitive drum 301 and the recording material 313 can freely be set, and hence has such features that designing can be created in a high degree of freedom, and the transfer efficiency, etc. can be easily optimized.

EXAMPLES

The present invention is further described below in greater detail by giving Examples. The present invention is by no means limited by these.

Example 1

Using the plasma-assisted CVD system shown in FIG. 2, deposition films were successively formed and superimposed on mirror-finished aluminum cylinders (supports) of 84 mm in diameter under conditions shown in Table 1, to produce photosensitive members each including the lower-part charge injection blocking layer, photoconductive layer, upper-part charge injection blocking layer and surface layer shown in FIG. 1C. As to the lower-part charge injection blocking layer, the photoconductive layer, the upper-part charge injection blocking layer and the surface layer, films were all formed under the conditions shown in Table 1 as common conditions. In regard to the surface layer, $SiH_4$ gas and $N_2$ gas flow rates and electric power were changed as shown in Table 2 for each photosensitive member, to change the mixing ratio of $SiH_4$ gas to $N_2$ gas and the electric power per $SiH_4$ gas quantity. As to other conditions, films were formed under the conditions shown in Table 1, to produce Photosensitive Members B to D. As to NO gas, $CO_2$ gas and optionally $CH_4$ gas, diluting gas cylinders were used when fed at low flow rates. Specifically, as to NO and $CO_2$ and as to $CH_4$, used were a 10% He diluting gas cylinder and a 10% $H_2$ diluting gas cylinder, respectively, switching them appropriately according to their flow rates. In the table, even when the diluting gas cylinders are used, the flow rates are represented in terms of the respective gas components and the concentrations are based on $SiH_4$.

Comparative Example 1

Photosensitive Members A (Comparative Example 1-1) and E (Comparative Example 1-2) having different nitrogen atom concentrations in surface layers were produced in the same manner as in Example 1 except that the $SiH_4$ gas and $N_2$ gas flow rates and electric power were set as shown in Table 2, changing the mixing ratio of $SiH_4$ to $N_2$ and the electric power according to $SiH_4$ gas quantity.

Actual nitrogen atom concentrations in the surface layers of Photosensitive Members A to E thus produced were analyzed using an ESCA (X-ray photoelectron spectroscopy) analyzer (QUANTUM 2000, manufactured by Ulvac-Phi, Inc.) and an SIMS (secondary-ion mass spectroscopy) analyzer (IMS-4F, manufactured by Cameca Instruments Japan K.K.) after influences of the outermost surface were removed by removing the surface by about 20 nm. The results obtained are shown in Table 2. The concentrations of oxygen atoms and carbon atoms also were measured. Though somewhat scattered due to difference in proportion of Si to Ni, the concentrations were in the range of 2.7 to 3.0 atm % in regard to oxygen atoms, and in the range of 2.1 to 3.5 atm % in regard to carbon atoms. The layer thickness of the surface layer of each of Photosensitive Members A to E was also measured with an interference layer thickness meter (MCPD-2000, manufactured by Otuska Electronics Co., Ltd.) in respect of six points in the peripheral direction of each spot of ten spots in the axial direction, i.e., sixty points in total, and the value (or range) found when the value of "maximum value–minimum value" was divided by an average layer thickness was defined as layer thickness non-uniformity (unit: %). The values of this layer thickness non-uniformity are also shown in Table 2.

Figure 4:
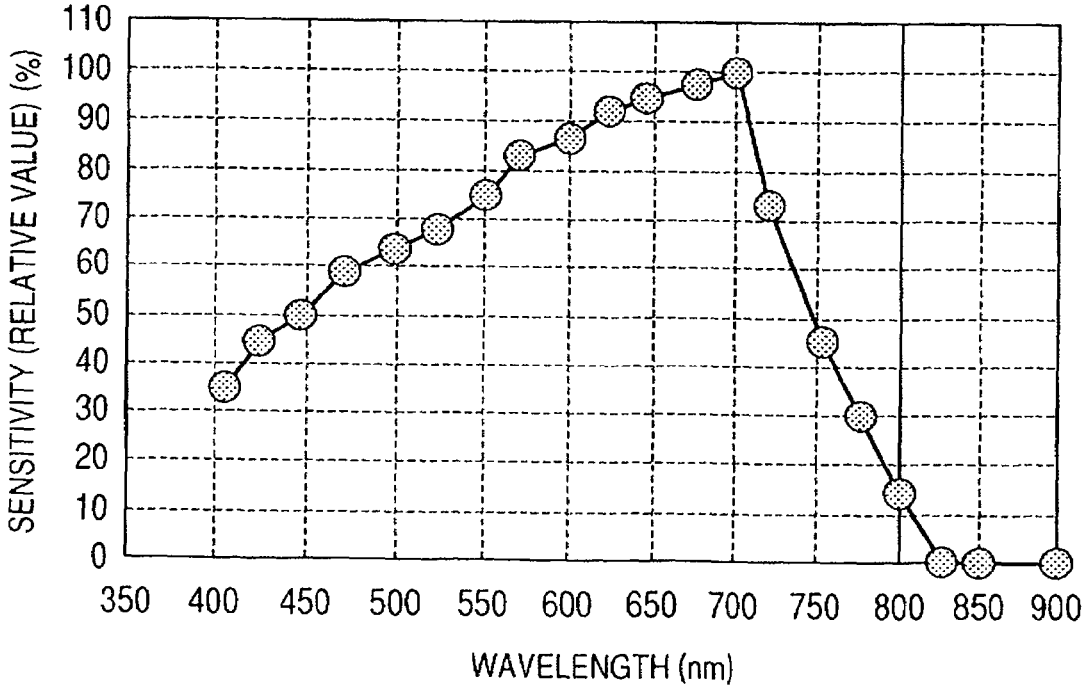
FIG. 4 is a graph showing the spectral sensitivity of the electrophotographic photosensitive member of the present invention.
Figure 5:
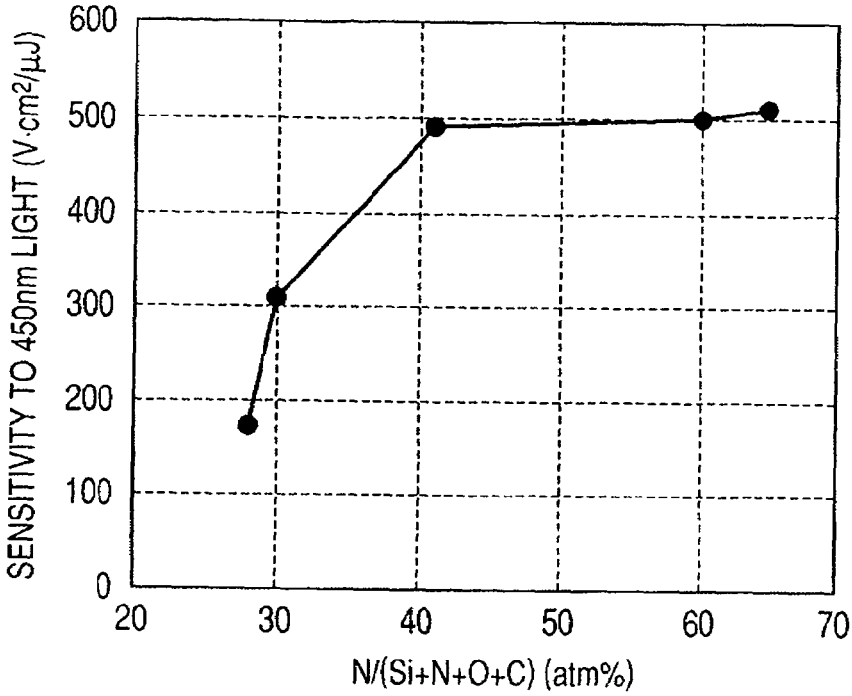
FIG. 5 is a relation graph showing the relationship between the concentration of nitrogen atoms in the surface layer of the electrophotographic photosensitive member of the present invention and the sensitivity to light of 405 nm in wavelength.
Figure 6:
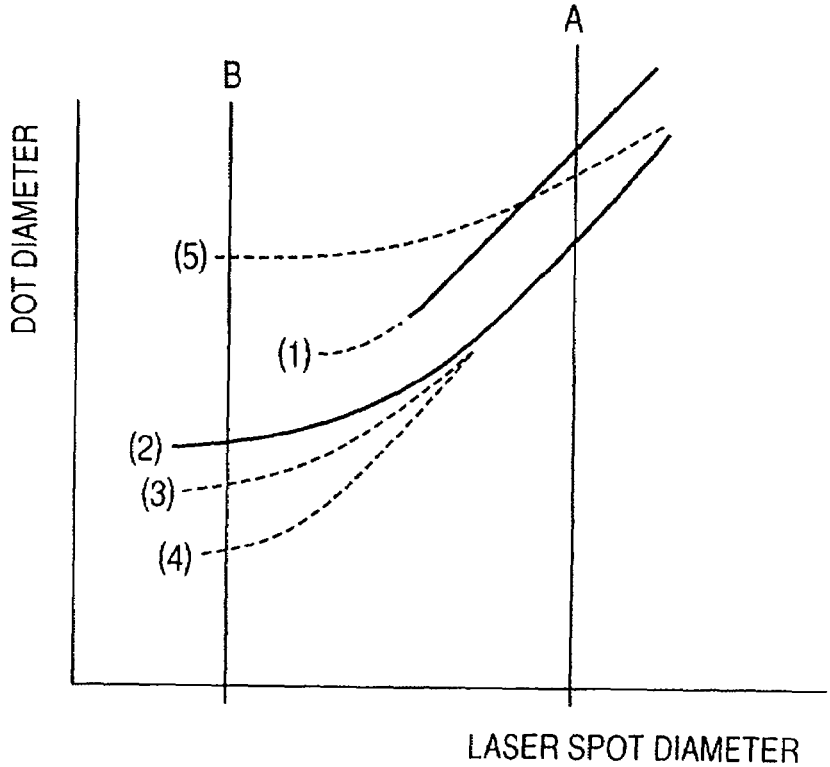
FIG. 6 is a graph showing the relationship between the spot diameter of laser light for exposure in the electrophotographic photosensitive member of the present invention and the spot diameter on a reproduced image.

Spectral sensitivity characteristics of Photosensitive Members A to E were also measured. Here, the spectral sensitivity characteristics refer to the following: The reciprocal of the amount of light necessary for causing photo-attenuation from a given dark-area potential to a given light-area potential, i.e., the level of potential attenuation per unit energy quantity of light was determined in respect of each wavelength, where the value of conversion of the level of potential attenuation in respect of each wavelength was shown as sensitivity, regarding the maximum level of potential attenuation as 100. An example of spectral sensitivity characteristics determined on Photosensitive Member D is shown in FIG. 4. The sensitivity to light of 405 nm in wavelength was also determined on each of Photosensitive Members A to E, obtaining the results shown in Table 2. Further, FIG. 5 shows a graph on which data are plotted in respect of the correlation between the nitrogen atom concentration in the surface layer and the sensitivity to the light of 405 nm in wavelength.

As is evident from the results shown in Table 2, it is seen that there is the clear correlation between the nitrogen atom concentration and the sensitivity to light of 405 nm in wavelength, and generally the sensitivity to 405 nm light becomes better with an increase in the nitrogen atom concentration, i.e., a tendency is shown to an improvement in adaptabiliy to blue-light-emitting semiconductor laser beams. In regard to Photosensitive Member A, when having a low nitrogen atom concentration in the surface layer, the sensitivity to the light of 405 nm in wavelength was so insufficient as to make it difficult for the photosensitive member to attain potential contrast high enough to be used in electrophotographic apparatus. The value of sensitivity required for electrophotographic processes depends on the performance of laser elements and optical systems to be used, and it is difficult to refer to its absolute value sweepingly. According to studies made by the present inventors, however, when measuring the spectral sensitivity without providing any surface layer, the value was found to be about 500 to 550 $Vcm^2/\mu J$ in the spectral sensitivity as shown in FIG. 5. Taking into account the absorption in the surface layer, it is considered preferable for the photosensitive member to have a sensitivity of 300 $Vcm^2/\mu J$ or more, and more preferably 400 $Vcm^2/\mu J$ or more. Thus, it turned out that, in order to attain such sensitivity to the short-wavelength laser beams of about 405 nm as in those of blue-light-emitting semiconductor lasers, the nitrogen atoms in the surface layer should be in a concentration of 30 atm % or more, and more preferably 35 atm % or more.

On the other hand, in Photosensitive Member E, its layer thickness non-uniformity was as large as 30% or more, and it turned out that the nitrogen atoms in the surface layer should preferably be 60 atm % or less, and more preferably 55 atm % or less.

Example 2

Photosensitive Member G including the lower-part charge injection blocking layer, photoconductive layer, upper-part charge injection blocking layer and surface layer as shown in FIG. 1C was produced in the same manner as in Example 1 except that the conditions shown in Table 3 were applied. As shown in Table 3, when the surface layer was formed, $CH_4$ gas and $CO_2$ gas were fed so as to bring oxygen atom concentration and carbon atom concentration to appropriate values.

Comparative Example 2

As comparative examples, Photosensitive Member H (Comparative Example 2-1) in which a-SiC:H was deposited as the surface layer and Photosensitive Member I (Comparative Example 2-2) in which neither oxygen atoms nor carbon atoms were fed were produced in the same manner as in Example 2 except that the surface layers were formed under the conditions shown in Table 3.

The concentrations of nitrogen atoms, oxygen atoms and carbon atoms in the surface layer of Photosensitive Member G were measured in the same way as in Example 1. The concentration of nitrogen atoms was found to be 0.42 as represented by the expression (3): N/(Si+N+O+C), the concentration of oxygen atoms to be 0.021 as represented by the expression (1): O/(Si+N+O+C), and the concentration of carbon atoms to be 0.039 as represented by the expression (2): C/(Si+N+O+C).

Photosensitive Members G, H and I were each set in an electrophotographic apparatus (a modified machine of an electrophotographic apparatus iRC6800, manufactured by CANON INC., which was so modified that, for experiments, the charging assembly was changed to a negative-charging magnetic brush system, the image exposure system used IAE (image exposure method) in which the light source for imagewise exposure was made exchangeable for a red-light-emitting semiconductor laser of 660 nm in oscillation wavelength or a blue-light-emitting semiconductor laser of 405 nm, and the drum surface irradiation spot diameter was made adjustable) (hereinafter "iRC-6800 modified machine), making the following evaluation.

First, Photosensitive Member G was used, and the blue color (405 nm) semiconductor laser was set as the exposure light source. A test chart in which 3-point size and 5-point size alphabets (A to Z) and complicated chinese characters corresponding to thunder and surprise in English were arranged in a resolution of 1,200 dpi was prepared on a personal computer, and an image obtained by printing the test chart in a printer mode was used to make evaluation of the resolution of the photosensitive member. Specifically, reproduced images were read by using a scanner (CanoScan 9900F, manufactured by CANON INC.), and image data thus read were compared with original data of the test chart. The area of portions deviated from letters and characters of the test original (thickened line images or thinned line images) was calculated, and the resolution of the photosensitive member was evaluated by the numerical values found. Since the exposure light wavelength was short, the laser spot diameter was able to be narrowed to 30 μm without using any special optical system. The area of portions deviated from original letters and characters was measured in a case in which the spot diameter was 30 μm and the resolution was 1,200 dpi. Here, this case was compared with four kinds of cases in total, i.e., in regard to Photosensitive Member H, a case in which images were formed at 600 dpi by using a beam of 60 μm in spot diameter of the red color (600 nm) semiconductor laser, and in regard to Photosensitive Member I, a case in which images were formed at 600 dpi by using a beam of 60 μm in spot diameter of the red color (600 nm) semiconductor laser, a case in which images were formed at 600 dpi by using a beam of 60 μm in spot diameter of the blue color (405 nm) semiconductor laser, and a case in which images were formed at 1,200 dpi by using a beam of 30 μm in spot diameter of the blue color (405 nm) semiconductor laser. Results obtained are shown in Table 4. The results Shown in the table were obtained by evaluating each photosensitive member according to the judgement criteria shown below, regarding as a reference (REF) the resolution of the case in which the beam 60 μm in spot diameter of the red color (600 nm) semiconductor laser was used in Photosensitive Member H.

AAA: Improved by 20% or more as compared with REF, showing a very good level.

AA: Improved by 10% or more as compared with REF, showing a fairly good level.

A: Improved by 5% or more as compared with REF, showing a good level.

B: Improved by less than 5% as compared with REF, showing substantially the same level as REF.

As is evident from the results shown in Table 4, the resolution did not depend on materials when the same wavelength (660 nm) and the same spot diameter (60 μm) were used. Even at the same spot diameter (60 μm), though the ranks were the same in Table 4, dot reproducibility in the case where the blue color (405 nm) semiconductor laser was used was somewhat enhanced as compared with that in the case where the red color (600 nm) semiconductor laser was used. This is considered due to a difference in carrier drift distance in the photoconductive layer. It was further revealed that where the blue color (405 nm) semiconductor laser was used, the spot diameter was able to be narrowed to 30 μm even when the same optical component parts were used, and hence dot reproducibility was greatly improved. However, by halving the spot diameter, the size of dots did not become halved, and there was a limit to the resolution in the case where the surface layer was formed of an amorphous silicon nitride material containing none of oxygen atoms and carbon atoms, whereas, in the case where the surface layer was formed of an amorphous silicon nitride material containing oxygen atoms and carbon atoms, the dot reproducibility was improvable, and the effect coming from narrowing the spot diameter was sufficiently exhibited.

Example 3

Five kinds of photosensitive members each including the lower-part charge injection blocking layer, photoconductive layer, upper-part charge injection blocking layer and surface layer shown in FIG. 1C were produced in the same manner as in Example 1 except that such conditions as shown in Table 5 were applied. The lower-part charge injection blocking layer, the photoconductive layer and the upper-part charge injection blocking layer were formed under the fixed conditions shown in Table 5, and the surface layer was formed changing the NO gas flow rate for each photosensitive member as shown in Table 6 and applying the conditions shown in Table 5, thereby producing Photosensitive Members J to N having different concentrations of oxygen atoms in the surface layers.

Comparative Example 3

As comparative examples, Photosensitive Members O (Comparative Example 3-1), P (Comparative Example 3-2) and Q (Comparative Example 3-3) were produced in the same manner as in Example 2 except that the NO gas flow rate in forming the surface layer was changed as shown in Table 6 or the NO gas was not added.

The concentrations of oxygen atoms, nitrogen atoms and carbon atoms in the surface layers of Photosensitive Members J to N were measured in the same way as in Example 1. The concentration of oxygen atoms was found to be 0.00012 to 0.197 as represented by the expression (1), the concentration of nitrogen atoms to be 0.41 to 0.51 as represented by the expression (3), and the concentration of carbon atoms to be 0.0051 as represented by the expression (2). The gain in content of oxygen atoms corresponded to the loss in content of nitrogen atoms, and the content of carbon atoms was substantially constant. Also, in the surface layers of Photosensitive Members O and P, the concentration of oxygen atoms was found to be 0.00004 and 0.21, respectively, as represented by the expression (1), the concentration of nitrogen atoms to be 0.39 and 0.51, respectively, as represented by the expression (3), and the concentration of carbon atoms to be both 0.0051 as represented by the expression (2). The gain in content of oxygen atoms corresponded to the loss in content of nitrogen atoms, and the content of carbon atoms was substantially constant.

Negative charging Photosensitive Members J to N and O to Q were each set in the iRC-6800 modified machine, and evaluation was made on resolution with respect to 405 nm image exposure light, environmental resistance and residual potential.

The evaluation results are shown in Table 6.

(1) Resolution (Dot Reproducibility):

The resolution in each photosensitive member was evaluated in the same way as in Example 2.

Regarding the resolution in Photosensitive Member Q as a reference (REF), the resolution was ranked according to the judgement criteria shown below.

AA: Less than 85%. Very superior.

A: 85% or more to less than 95%. Superior.

B: 95% or more to less than 105%. On the level of the reference.

(2) Environmental Resistance:

Next, to evaluate the environmental resistance of the photosensitive members, the above electrophotographic apparatus for experiment was placed in a high-temperature and high-humidity environment laboratory at a temperature of 30° C. and a relative humidity of 80%, and an A4 copying paper 500,000-sheet paper-feed running test was conducted while image characteristics were evaluated at given intervals.

Evaluation was made using two kinds of images:

(1) an image in which pixel density changes stepwise from 0% to 100%; and (2) an image in which 5-point size letters are arranged.

Specifically, using the image (1), whether or not microscopic image deletion at a dot level appeared was evaluated by the gradation of halftones, i.e., the linearity of pixel density and image density, and, using the image (2), whether or not image deletion ascertainable at the letter level appeared was evaluated. Then, image characteristics in the above high-temperature and high-humidity environment were further evaluated under the control of the exposure optical system at 600 dpi, 1,200 dpi and 2,400 dpi. The results obtained by the above measurement were judged on each photosensitive member according to the criteria shown below.

AA: No image deletion appears throughout running. Very superior.

A: Halftone gradation lowers in some cases with the progress of running immediately after the machine is started first in the morning, but is completely recovered after feeding a few sheets of paper. Superior.

B: Iimage deletion recognizable at the letter level appear in some cases with the progress of running immediately after the machine is started first in the morning, but good images are completely recovered after feeding a few sheets of paper. No problem in practical use.

(3) Residual Potential:

The charging assembly was so controlled that the photosensitive members each had a surface potential of −450 V (dark potential) at the position of the developing assembly. Thereafter, each photosensitive member was irradiated with image exposure light (a semiconductor laser beam of 405 nm in wavelength) twice to three times (in practice, e.g., about 2 to 3 $\mu J/cm^2$) the amount of practical light to lower the surface potential completely. The surface potential at which this value was sufficiently saturated with respect to the amount of exposure light was regarded as the residual potential.

The results obtained were ranked according to the following criteria, regarding the value of Photosensitive Member Q as 100%.

AA: Less than 85%. Very superior.

A: 85% or more to less than 95%. Superior.

B: 95% or more to less than 105%. On the level of the reference.

(4) Photomemory:

As photomemory potential, the potential difference between the surface potential measured in a non-image-exposure state and the surface potential measured when the photosensitive member was first imagewise exposed and thereafter charged again was determined by using the same potential sensor under the evaluation conditions for "sensitivity". The results obtained were ranked according to the following criteria, regarding the value of Photosensitive Member Q as 100%.

AA: Less than 85%. Very superior.

A: 85% or more to less than 95%. Superior.

B: 95% or more to less than 105%. On the level of the reference.

From the results shown in Table 6, regarding the comparative example Photosensitive Member Q as a reference, the resolution is seen to be improved when the oxygen atom content in the surface layer is in a certain value or more. In respect of other characteristics as well, optimum values are seen to be shown when the oxygen atoms are in an appropriate content. In particular, it turned out that all the characteristics were very superior when the oxygen atom content was 0.5 atm % or more to 10 atm % or less. On the other hand, it turned out that the results were on the level of the reference in the evaluation on image deletion and the evaluation of residual potential when the oxygen atom content was in excess of 20 atm %. Thus, it turned out that the oxygen atoms should be in a content of from 0.01 atm % or more to 20 atm % or less, and more preferably from 0.5 atm % or more to 10 atm % or less.

Example 4

Five kinds of photosensitive members each including the lower-part charge injection blocking layer, photoconductive layer, upper-part charge injection blocking layer and surface layer shown in FIG. 1C were produced in the same manner as in Example 1 except that such conditions as shown in Table 7 were applied. The lower-part charge injection blocking layer, the photoconductive layer and the upper-part charge injection blocking layer were formed under the fixed conditions shown in Table 7, and the surface layer was formed changing the $CH_4$ gas flow rate for each photosensitive member as shown in Table 8 and applying the conditions shown in Table 7, thereby producing Photosensitive Members R to V having different concentrations of carbon atoms in the surface layers. When the $CH_4$ gas was fed at a low flow rate, it was diluted with hydrogen gas to accurately control its flow rate. In addition, the hydrogen gas flow rates shown in Table 7 are shown as values including that of the diluting hydrogen.

Comparative Example 4

As comparative examples, Photosensitive Members W (Comparative Example 4-1) and X (Comparative Example 4-2) were produced in the same manner as in Example 4 except that the $CH_4$ gas flow rate in forming the surface layer was changed as shown in Table 8.

The carbon atom concentration, nitrogen atom concentration and oxygen atom concentration in the surface layers of Photosensitive Members R to V were measured in the same way as in Example 1. The concentration of carbon atoms was found to be 0.00014 to 0.096 as represented by the expression (2), the concentration of nitrogen atoms to be 0.46 to 0.52 as represented by the expression (3), and the concentration of oxygen atoms to be 0.0053 as represented by the expression (2). The gain in content of carbon atoms corresponded to the loss in content of nitrogen atoms, and the content of oxygen atoms was substantially constant. Also, in the surface layers of Photosensitive Members W and X, the concentration of carbon atoms was found to be 0.00004 to 0.13 as represented by the expression (2), and the concentration of nitrogen atoms to be 0.45 to 0.52 as represented by the expression (3). The gain in content of carbon atoms corresponded to the loss in content of nitrogen atoms, and the content of oxygen atoms was substantially constant at 0.0053 as represented by the expression (1).

Negative charging Photosensitive Members R to V, W and X were each set in the electrophotographic apparatus as used in Example 3, and their resolution and residual potential were evaluated in the same way as in Example 3. However, in place of the evaluation on image deletion which was made in Example 3, the sensitivity was evaluated in the following way.

(5) Sensitivity:

The charging assembly was so controlled that the photosensitive members each had a surface potential of −450 V (dark potential) at the position of the developing assembly. Thereafter, each photosensitive member was irradiated with image exposure light (a semiconductor laser beam of 405 nm in wavelength), and the amount of light of an image exposure light source was controlled so as to give a surface potential of −100 V (light potential). The amount of exposure light on that occasion was regarded as the sensitivity. The results obtained were ranked according to the following criteria, regarding the value in Photosensitive Member Q as 100%. The results are shown in Table 8.

AA: Less than 85%. Very superior.

A: 85% or more to less than 95%. Superior.

B: 95% or more to less than 105%. On the level of the reference.

C: 105% or more. Somewhat inferior to the reference.

From the results shown in Table 8, the resolution is seen to be improved when the carbon atom content was in a certain value or more. In respect of other characteristics as well, optimum values are seen to be shown when the carbon atoms are in an appropriate content. In particular, it turned out that all the characteristics were very superior when the carbon atom content was 0.5 atm % or more to 5 atm % or less. On the other hand, it turned out that the sensitivity lowered abruptly when the carbon atom content was 10 atm % or more, because the composition approximated to SiC. It also turned out that the evaluation of the residual potential was on the level of the reference. Thus, it turned out that the carbon atoms should be in a content of from 0.01 atm % or more to 10 atm % or less, and more preferably from 0.5 atm % or more to 5 atm % or less.

Example 5

Four kinds of photosensitive members each including the lower-part charge injection blocking layer, photoconductive layer, upper-part charge injection blocking layer and surface layer shown in FIG. 1C were produced in the same manner as in Example 1 except that such conditions as shown in Table 9 were applied. The lower-part charge injection blocking layer, the photoconductive layer and the upper-part charge injection blocking layer were formed under the fixed conditions shown in Table 9. The surface layer was formed changing nitrogen atom concentration and oxygen atom concentration so that the number of atoms incorporated per unit length in the layer thickness direction was changed, by feeding $N_2$ gas and $CO_2$ gas at flow rates varied as shown in Table 10.

The following four kinds of photosensitive members were produced: Photosensitive Member AA in which the nitrogen atom content in the surface layer increases toward the surface side in the layer thickness direction, Photosensitive Member BB in which the oxygen atom content increases toward the surface side in the layer thickness direction, Photosensitive Member AB in which both oxygen atoms and carbon atoms increase toward the surface side but the oxygen atoms always increase in a larger proportion than the proportion in which the carbon atoms increase, i.e., the value of "O/N" which is the ratio of the number O of oxygen atoms contained per unit length in the thickness direction to the number N of nitrogen atoms contained per unit length in the thickness direction increases toward the surface side, and Photosensitive Member CC in which both the oxygen atom concentration and the carbon atom concentration are constant.

The content of oxygen atoms and content of nitrogen atoms in the surface layers of the photosensitive members were measured in the same way as in Example 1. Results obtained are shown in Table 10. Also, after resolution and photomemory were evaluated, the gradient-composition distribution was ascertained by SIMS. Still also, as to the average concentration in the film, the average value in the depth direction was determined by ESCA while carrying out sputtering.

The photosensitive members were evaluated on their resolution and photomemory in the same way as in Example 1 and according to the following criteria, regarding Photosensitive Member CC as a reference. The results are shown in Table 10.

AA: Less than 85%. Very superior.

A: 85% or more to less than 95%. Superior.

B: 95% or more to less than 105%. On the level of the reference.

It is seen from Table 10 that all the Photosensitive Members AA, BB and AB are improved in resolution and photomemory characteristics as compared with Photosensitive Member CC in which the nitrogen atom concentration and oxygen atom concentration are set constant, and the level of improvement is higher in the order of AA, BB and AB, and in particular, Photosensitive Member AB in which both nitrogen atoms and oxygen atoms are in gradient distribution and further the gradient of oxygen atoms is made larger, shows much better characteristics. From this fact, it turned out that the resolution and photomemory characteristics were further improved by providing the gradient distribution when the average concentrations of nitrogen atoms and oxygen atoms were substantially set alike, and that optimum characteristics were obtainable by distributing the atoms so as to cause an increase in the value of "O/N", the ratio of the number O of oxygen atoms to the number N of nitrogen atoms.

Example 6

Using the plasma-assisted CVD system shown in FIG. 2, deposition films were successively formed on a mirror-finished aluminum cylinder (support) of 84 mm in diameter under such conditions as shown in Table 11, to produce Photosensitive Member DD including the lower-part charge injection blocking layer, photoconductive layer, gradient-composition layer, upper-part charge injection blocking layer, change layer and surface layer as shown in FIG. 1D. The film forming gases were introduced with smooth changes so that optical interfaces were not creaeted between the photoconductive layer and the upper-part charge injection blocking layer and between the upper-part charge injection blocking layer and the surface layer, and refractive indexes were gently changed.

The concentrations of nitrogen atoms, oxygen atoms and carbon atoms in the surface layer of Photosensitive Member DD were measured in the same way as in Example 1. The concentration of nitrogen atoms was found to be 0.48 as represented by the expression (3), the concentration of oxygen atoms to be 0.02 as represented by the expression (1), and the concentration of carbon atoms to be 0.0072 as represented by the expression (2).

Photosensitive Member DD was evaluated on its resolution, environmental resistance, residual potential and photomemory in the same way as in Example 3, regarding Photosensitive Member Q as a reference, and its sensitivity was evaluated in the same way as in Example 4, regarding Photosensitive Member Q as a reference. The results are shown in Table 12.

From the results shown in Table 12, Photosensitive Member DD is seen to show characteristics very superior to those of Photosensitive Member Q in all the items. It is also evident that because of reduced interference, the sensitivity non-uniformity does not easily occur even when the surface is scraped non-uniformly. Thus, it was revealed that a more preferable photosensitive member was obtainable by smoothly connecting compositional ratios so as not to create the optical interfaces between the photoconductive layer and the upper-part charge injection blocking layer and between the upper-part charge injection blocking layer and the surface layer.

Example 7

Photosensitive members 2B to 2D each including the lower-part charge injection blocking layer, photoconductive layer, upper-part charge injection blocking layer and surface layer as shown in FIG. 1C were produced in the same manner as in Example 1 except that such conditions as shown in Table 13 were applied.

Comparative Example 5

Photosensitive Members 2A (Comparative Example 5-1) and 2E (Comparative Example 5-2) having different nitrogen atom concentrations in surface layers were produced in the same manner as in Example 7 except that the $SiH_4$ gas and $N_2$ gas flow rates, the mixing ratio of $SiH_4$ to $N_2$ and the electric power per $SiH_4$ gas quantity were changed as shown in Table 14, and the mixing ratio of $SiH_4$ to $N_2$ and the electric power per $SiH_4$ gas quantity were changed.

Photosensitive Members 2A to 2E thus produced were evaluated in the same way as in Example 1. The results are shown in Table 14. Their oxygen atom concentration and carbon atom concentration were also measured in the same way. Although the values somewhat scattered because of a difference in the proportion of Si to N, the concentration was in the range of from 2.7 to 3.0 atm % in regard to oxygen atoms, and in the range of from 2.1 to 3.5 atm % in regard to carbon atoms.

The optical sensitivity characteristics of Photosensitive Members 2A to 2E were also measured in the same way as in Example 1, obtaining the results shown in Table 14.

As is evident from the results shown in Table 14, the same results as those in Example 1 were obtained.

Example 8

Photosensitive Member 2G including the lower-part charge injection blocking layer, the photoconductive layer, the upper-part charge injection blocking layer and the surface layer was produced in the same manner as in Example 7 except that such conditions as shown in Table 15 were applied. As shown in Table 15, when the surface layer was formed, $CH_4$ gas and $CO_2$ gas were fed so as to bring oxygen atom concentration and carbon atom concentration to appropriate values.

Comparative Example 6

As comparative examples, Photosensitive Member 2H (Comparative Example 6-1) in which a-SiC:H was deposited as the surface layer and Photosensitive Member 2I (Comparative Example 6-2) in which neither oxygen atoms nor carbon atoms were fed were produced in the same manner as in Example 8 except that the surface layers were formed under such conditions as shown in Table 15.

The concentrations of nitrogen atoms, oxygen atoms and carbon atoms in the surface layer of Photosensitive Member 2G were measured in the same way as in Example 7. The concentration of nitrogen atoms was found to be 0.42 as represented by the expression (3): N/(Si+N+O+C), the concentration of oxygen atoms to be 0.021 as represented by the expression (1): O/(Si+N+O+C), and the concentration of carbon atoms to be 0.039 as represented by the expression (2): C/(Si+N+O+C).

Photosensitive Members 2G, 2H and 2I were evaluated in the same way as in Example 2, regarding 2H as a reference, using the electrophotographic apparatus (the modified machine of an electrophotographic apparatus iRC6800, manufactured by CANON INC.).

The results obtained are shown in Table 16.

The table shows the results obtained by evaluating the resolution of each photosensitive member according to the judgement criteria shown below, regarding as a reference (REF) the resolution of a case in which the beam 60 μm in spot diameter of the red color (600 nm) semiconductor laser was used in Photosensitive Member 2H, and applying the method shown in Example 7.

AAA: Improved by 20% or more as compared with REF, showing a very good level.

AA: Improved by 10% or more as compared with REF, showing a fairly good level.

A: Improved by 5% or more as compared with REF, showing a good level.

B: Improved by less than 5% as compared with REF, showing substantially the same level as REF.

As is evident from the results shown in Table 16, the same results as those in Example 2 were obtained.

Example 9

Five kinds of photosensitive members each including the lower-part charge injection blocking layer, the photoconductive layer, the upper-part charge injection blocking layer and the surface layer were produced in the same manner as in Example 7 except that such conditions as shown in Table 17 were applied. The lower-part charge injection blocking layer, the photoconductive layer and the upper-part charge injection blocking layer were formed under the fixed conditions shown in Table 17, and the surface layer was formed changing the NO gas flow rate for each photosensitive member as shown in Table 18 and applying the conditions shown in Table 17, thereby producing Photosensitive Members 2J to 2N having different concentrations of oxygen atoms in the surface layers.

Comparative Example 7

As comparative examples, Photosensitive Members 2O (Comparative Example 7-1) and 2P (Comparative Example 7-2) were produced in the same manner as in Example 9 except that the NO gas flow rate in forming the surface layer was changed as shown in Table 18. Photosensitive Member 2Q (Comparative Example 7-3) was also produced in the same manner as in Example 9 except that the NO gas was not added.

The concentrations of oxygen atoms, nitrogen atoms and carbon atoms in the surface layers of Photosensitive Members 2J to 2N were measured in the same way as in Example 7. The concentration of oxygen atoms was found to be 0.00012 to 0.197 as represented by the expression (1), the concentration of nitrogen atoms to be 0.41 to 0.51 as represented by the expression (3), and the concentration of carbon atoms to be 0.0051 as represented by the expression (2). The gain in content of oxygen atoms corresponded to the loss in content of nitrogen atoms, and the content of carbon atoms was substantially constant. Also, in the surface layers of Photosensitive Members 2O and 2P, the concentration of oxygen atoms was found to be 0.00004 and 0.21, respectively, as represented by the expression (1), the concentration of nitrogen atoms to be 0.39 and 0.51, respectively, as represented by the expression (3), and the concentration of carbon atoms to be both 0.0051 as represented by the expression (2). The gain in content of oxygen atoms corresponded to the loss in content of nitrogen atoms, and the content of carbon atoms was substantially constant.

Negative charging Photosensitive Members 2J to 2N and 2O to 2Q were each set in the iRC-6800 modified machine, and evaluation was made on resolution with respect to 405 nm image exposure light, environmental resistance and residual potential in the same way as in Example 3.

The evaluation results are shown in Table 18.

(1) Resolution (Dot Reproducibility):

The resolution in the photosensitive member was evaluated in the same way as in Example 8. Regarding the resolution in Photosensitive Member 2Q as a reference (REF), the resolution was ranked according to the judgement criteria shown below.

AA: Less than 85%. Very superior.

A: 85% or more to less than 95%. Superior.

B: 95% or more to less than 105%. On the level of the reference.

(2) Environmental Resistance:

Evaluation was made in the same way as in Example 3.

The results obtained by the measurement were judged on each photosensitive member according to the criteria shown below.

AA: No image deletion appears throughout running. Very superior.

A: Halftone gradation lowers in some cases with the progress of running immediately after the machine is started first in the morning, but is completely recovered after feeding a few sheets of paper. Superior.

B: Image deletion recognizable at the letter level appear in some cases with the progress of running immediately after the machine is started first in the morning, but good images are completely recovered after feeding a few sheets of paper. No problem in practical use.

(3) Residual Potential:

Evaluation was made in the same way as in Example 3.

The results obtained were ranked regarding the value of Photosensitive Member 2Q as 100%.

AA: Less than 85%. Very superior.

A: 85% or more to less than 95%. Superior.

B: 95% or more to less than 105%. On the level of the reference.

(4) Photomemory:

Photomemory potential was determined in the same way as in Example 3.

The results obtained were ranked regarding the value of Photosensitive Member 2Q as 100%.

AA: Less than 85%. Very superior.

A: 85% or more to less than 95%. Superior.

B: 95% or more to less than 105%. On the level of the reference.

Regarding the comparative example Photosensitive Member Q as a reference, the resolution is seen to be improved when the oxygen atom content in the surface layer is in a certain value or more. In respect of other characteristics as well, optimum values are seen to be shown when the oxygen atoms are in an appropriate content. In particular, it turned out that all the characteristics were very superior when the oxygen atom content was 0.5 atm % or more to 10 atm % or less. On the other hand, it turned out that the results were on the level of the reference in the evaluation on image deletion and the evaluation of residual potential when the oxygen atom content was in excess of 20 atm %. Thus, it turned out that the oxygen atoms should be in a content of from 0.01 atm % or more to 20 atm % or less, and more preferably from 0.5 atm % or more to 10 atm % or less.

Example 10

Five kinds of photosensitive members were produced in the same manner as in Example 7 except that such conditions as shown in Table 19 were applied. The lower-part charge injection blocking layer, the photoconductive layer and the upper-part charge injection blocking layer were formed under the fixed conditions shown in Table 19, and the surface layer was formed changing the $CH_4$ gas flow rate for each photosensitive member as shown in Table 20 and applying the conditions shown in Table 19, thereby producing Photosensitive Members 2R to 2V having different concentrations of carbon atoms in the surface layers. When the $CH_4$ gas was flowed at a low rate, it was diluted with hydrogen gas to control its flow rate accurately. In addition, the hydrogen gas flow rates shown in Table 20 are shown as values including that of the diluting hydrogen.

Comparative Example 8

As comparative examples, Photosensitive Members 2W (Comparative Example 8-1) and 2X (Comparative Example 8-2) were produced in the same manner as in Example 10 except that the $CH_4$ gas flow rate in forming the surface layer was changed as shown in Table 20.

The carbon atom concentration, nitrogen atom concentration and oxygen atom concentration in the surface layers of Photosensitive Members 2R to 2V were measured in the same way as in Example 7. The concentration of carbon atoms was found to be 0.00014 to 0.096 as represented by the expression (2), the concentration of nitrogen atoms to be 0.46 to 0.52 as represented by the expression (3), and the concentration of oxygen atoms to be 0.0053 as represented by the expression (2). The gain in content of carbon atoms corresponded to the loss in content of nitrogen atoms, and the content of oxygen atoms was substantially constant. Also, in the surface layers of Photosensitive Members 2W and 2X, the concentration of carbon atoms was found to be 0.00004 to 0.13 as represented by the expression (2), and the concentration of nitrogen atoms to be 0.45 to 0.52 as represented by the expression (3). The gain in content of carbon atoms corresponded to the loss in content of nitrogen atoms, and the content of oxygen atoms was substantially constant at 0.0053 as represented by the expression (1).

Negative charging Photosensitive Members 2R to 2V, 2W and 2X produced were evaluated on their resolution and residual potential in the same way as in Example 9. However, in place of the evaluation on image deletion which was made in Example 9, the sensitivity was evaluated in the same way as in Example 4.

The results obtained were ranked regarding the value in Photosensitive Member Q as 100%, and are shown in Table 8.

AA: Less than 85%. Very superior.

A: 85% or more to less than 95%. Superior.

B: 95% or more to less than 105%. On the level of the reference.

C: 105% or more. Somewhat inferior to the reference.

From Table 20, the same results as those in Example 4 are seen to have been obtained.

Example 11

Four kinds of photosensitive members were produced in the same manner as in Example 1 except that such conditions as shown in Table 21 were applied. The lower-part charge injection blocking layer, the photoconductive layer and the upper-part charge injection blocking layer were formed under the fixed conditions shown in Table 21. The surface layer was formed changing the nitrogen atom concentration and oxygen atom concentration so that the number of atoms incorporated per unit length in the layer thickness direction was changed, by feeding $N_2$ gas and $CO_2$ gas at flow rates varied as shown in Table 22.

The following four kinds of photosensitive members were produced: Photosensitive Member 2AA in which the nitrogen atom content in the surface layer increases toward the surface side in the layer thickness direction; Photosensitive Member 2BB in which the oxygen atom content increases toward the surface side in the layer thickness direction; Photosensitive Member 2AB in which both oxygen atoms and carbon atoms increase toward the surface side, but the oxygen atoms always increase in a larger proportion than the proportion in which the carbon atoms increase, i.e., the value of "O/N" which is the ratio of the number O of oxygen atoms contained per unit length in the thickness direction to the number N of nitrogen atoms contained per unit length in the thickness direction increases toward the surface side; and Photosensitive Member 2CC in which both the oxygen atom concentration and the carbon atom concentration are constant.

The content of oxygen atoms and the content of nitrogen atoms in the surface layers of the photosensitive members produced were measured in the same way as in Example 7. Results obtained are shown in Table 22. Also, after resolution and photomemory were evaluated, the gradient-composition distribution was ascertained by SIMS. Still also, as to the average concentrations in the films, the average values in the depth direction were determined by using ESCA while carrying out sputtering.

The photosensitive members obtained were evaluated on their resolution and photomemory in the same way as in Example 9 according to the following criteria, regarding Photosensitive Member 2CC as a reference. The results are shown in Table 22.

AA: Less than 85%. Very superior.

A: 85% or more to less than 95%. Superior.

B: 95% or more to less than 105%. On the level of the reference.

As is evident from Table 22, the same results as those in Example 5 were obtained.

Example 12

Using the plasma-assisted CVD system shown in FIG. 2, deposition films were successively formed on a mirror-finished aluminum cylinder (support) of 84 mm in diameter under the conditions shown in Table 23, to produce Photosensitive Member DD including the lower-part charge injection blocking layer, the photoconductive layer, the gradient-composition layer, the upper-part charge injection blocking layer, the change layer and the surface layer. The film forming gase were introduced with smooth changes so that optical interfaces were not created between the photoconductive layer and the upper-part charge injection blocking layer and between the upper-part charge injection blocking layer and the surface layer, and refractive indexes were gently changed.

The concentrations of nitrogen atoms, oxygen atoms and carbon atoms in the surface layer of Photosensitive Member 2DD were measured in the same way as in Example 7. The concentration of nitrogen atoms was found to be 0.48 as represented by the expression (3), the concentration of oxygen atoms to be 0.02 as represented by the expression (1), and the concentration of carbon atoms to be 0.0072 as represented by the expression (2).

Photosensitive Member 2DD was evaluated on its resolution, environmental resistance, residual potential and photomemory in the same way as in Example 9, regarding Photosensitive Member 2Q as a reference, and its sensitivity was evaluated in the same way as in Example 10, regarding Photosensitive Member 2Q as a reference. The results are shown in Table 24.

From the results, Photosensitive Member 2DD is seen to show characteristics very superior to those of Photosensitive Member 2Q in all the items. It is also evident that because of reduced interference, the sensitivity non-uniformity does not easily occur when the surface is scraped non-uniformly. Thus, it was made evident that a more preferable photosensitive member was obtainable by smoothly changing the compositional ratio so as to create no optical interfaces between the photoconductive layer and the upper-part charge injection blocking layer and between the upper-part charge injection blocking layer and the surface layer.

Example 13

Photosensitive members were produced in the same manner as in Example 7 except that such conditions as shown in Table 25 were applied. The lower-part charge injection blocking layer, the photoconductive layer and the surface layer were formed under the fixed conditions shown in Table 25, and the upper-part charge injection blocking layer was formed changing the $CH_4$ gas flow rate for each photosensitive member as shown in Table 26, and applying the conditions shown in Table 25, thereby producing Photosensitive Members 2EE to 2JJ having different concentrations of carbon atoms in the upper-part charge injection blocking layers. The layer thickness was 50 nm.

The carbon atom concentration, nitrogen atom concentration and oxygen atom concentration in the surface layers of Photosensitive Members 2EE to 2JJ were measured in the same way as in Example 7. The concentration of carbon atoms was found to be 0.014 as represented by the expression (2), the concentration of nitrogen atoms to be 0.45 as represented by the expression (3), and the concentration of oxygen atoms to be 0.028 as represented by the expression (1). The content of boron atoms in the upper-part charge injection blocking layer was about 500 atm ppm.

The photosensitive members were evaluated on their chargeability and sensitivity, regarding Photosensitive Member 2EE as a reference in which C/(Si+C) was 8 atm %.

The evaluation of chargeability was made in the following way, and the evaluation of sensitivity was made in the same way as in Example 10, regarding Photosensitive Member 2EE as a reference.

(5) Evaluation of Chargeability:

The electrophotographic photosensitive members produced were each set in the iRC-6800 modified machine, and charged electrostatically to measure the dark-area surface potential of each electrophotographic photosensitive member by using a surface potentiometer installed at the position of developing assembly. Here, charging conditions such as DC voltage applied to the charging assembly, amplitude of superimposed AC, and frequency were set to be constant.

The results obtained were ranked regarding the value in Photosensitive Member 2EE as 100%, and are shown in Table 26.

AA: 115% or more. Very superior.

A: 105% or more to less than 115%. Superior.

B: 95% or more to less than 105%. On the level of the reference.

From the results shown Table 26, Photosensitive Members 2FF to 2JJ are seen to show sensitivities superior to those of Photosensitive Member 2EE, and show very superior characteristics especially when the carbon atom concentration is 0.15 or more as represented by the expression (4). It also turned out that their chargeability was superior when the carbon atom concentration was 0.1 to 0.5 as represented by the expression (4), and very superior especially when it was 0.15 to 0.4. The reason therefor is considered to be that in Photosensitive Member 2EE, the carbon atoms were in so low a content that the valence electron controlling agent was high effective to cause a great dark attenuation due to carriers produced by heat, to therefore result in an inferior chargeability. It is also considered that in Photosensitive Member 2JJ, conversely the valence electron controlling agent was low effective to cause a lowering in blocking ability to therefore result in somewhat low chargeability.

From the foregoing results, it was revealed that in regard to the carbon atom content in the upper-part charge injection blocking layer, it was preferably from 0.1 or more to 0.5 or less, and more preferably from 0.15 or more to 0.4 or less as represented by the expression (4).

Example 14

Photosensitive members were produced in the same manner as in Example 7 except that such conditions as shown in Table 27 were applied. The lower-part charge injection blocking layer, the photoconductive layer and the surface layer were formed under the fixed conditions shown in Table 27, and the upper-part charge injection blocking layer was formed changing the $B_2H_6$ gas flow rate for each photosensitive member as shown in Table 28 and applying the conditions shown in Table 27, thereby producing six kinds of Photosensitive Members 2KK to 2PP having the boron atom content of from 50 atm ppm to 4,000 atm ppm in the upper-part charge injection blocking layers. The layer thickness of each upper-part charge injection blocking layer was set at 70 nm.

The carbon atom concentration, nitrogen atom concentration and oxygen atom concentration in the surface layers of Photosensitive Members 2KK to 2PP were measured in the same way as in Example 7. The concentration of carbon atoms was found to be 0.014 as represented by the expression (2), the concentration of nitrogen atoms to be 0.45 as represented by the expression (3), and the concentration of oxygen atoms to be 0.028 as represented by the expression (1). The content of carbon atoms in the upper-part charge injection blocking layer was found to be 0.3 as represented by the expression (4).

The photosensitive members were evaluated on their chargeability and resolution, regarding Photosensitive Member 2PP as a reference in which boron atom content was 4,000 atm ppm. The evaluation of chargeability was made in the same way as in Example 13, and the evaluation of resolution was made in the same way as in Example 8. The results are shown in Table 28.

From the results shown Table 28, Photosensitive Members 2KK to 2OO are seen to show resolutions superior to those of Photosensitive Member 2PP, and show very superior characteristics especially when the boron atom concentration is 2,000 atm ppm or less. Meanwhile, in regard to chargeability as well, Photosensitive Members 2KK to 2OO are seen to be very superior especially when the boron atom concentration is 100 to 2,000 atm ppm.

From the foregoing results, it turned out that in regard to the boron atom content in the upper-part charge injection blocking layer, it was preferably from 50 atm ppm or more to 3,000 atm ppm or less, and more preferably from 100 atm ppm or more to 2,000 atm ppm or less.

Example 15

Photosensitive members were produced in the same manner as in Example 7 except that such conditions as shown in Table 29 were applied. The lower-part charge injection blocking layer, the photoconductive layer and the surface layer were formed under the fixed conditions shown in Table 29, and the upper-part charge injection blocking layer was formed changing its layer thickness for each photosensitive member as shown in Table 30 and applying the conditions shown in Table 29, thereby produce six kinds of Photosensitive Members 2QQ to 2VV having different layer thicknesses of the upper-part charge injection blocking layers.

The concentration of carbon atoms in each of the upper-part charge injection blocking layers of Photosensitive Members 2QQ to 2VV was found to be about 0.25 as represented by the expression (4), and the content of boron atoms to be about 400 ppm. The carbon atom concentration, nitrogen atom concentration and oxygen atom concentration in each of the surface layers were measured in the same way as in Example 7. The concentration of carbon atoms was found to be 0.014 as represented by the expression (2), the concentration of nitrogen atoms to be 0.45 as represented by the expression (3), and the concentration of oxygen atoms to be 0.028 as represented by the expression (1).

The photosensitive members were evaluated on their chargeability in the same way as in Example 13 and sensitivity in the same way as in Example 8, regarding Photosensitive Member 2VV as a reference in which the layer thickness of the upper-part charge injection blocking layer was 200 nm. The results are shown in Table 30.

From the results shown Table 30, Photosensitive Members 2QQ to 2UU are seen to be superior to Photosensitive Member 2VV. Photosensitive Member 2UU is seen to be somewnat superior, but at the level of Photosensitive Member 2VV as ranks; Photosensitive Member 2TT in which the layer thickness of the upper-part charge injection blocking layer is 100 nm, to show superior characteristics; and Photosensitive Members 2QQ to 2SS in which the layer thickness is 50 nm or less, to show very superior characteristics. Meanwhile, in regard to chargeability, Photosensitive Member 2UU, in which the layer thickness is 150 nm, is seen to be at the level of Photosensitive Member 2VV, and Photosensitive Members 2QQ, 2RR, 2SS and 2TT, in which the layer thickness is 5 nm, 30 nm, 50 nm and 100 nm, respectively, to be very superior. It is considered that such a difference results from the fact that in Photosensitive Member 2TT, the total content of the boron atoms contained in the whole layer is somewhat larger because of its large layer thickness, to thereby cause a great dark attenuation due to carriers produced by heat.

From the foregoing results, it turned out that in regard to the layer thickness of the upper-part charge injection blocking layer, it was preferably from 5 nm or more to 150 nm or less, and more preferably 100 nm or less, and particularly 50 nm or less.

TABLE 1

| Source gases & conditions | Lower-part charge injection blocking layer | Photo-conductive layer | Upper-part charge injection blocking layer | Surface layer |
|---|---|---|---|---|
| $SiH_4$ [ml/min(normal)] | 170 | 170 | 50 | 20 to 80[2)] |
| $H_2$ [ml/min(normal)] | 600 | 1,000 | 100 | 100 |
| $CH_4$ [ml/min(normal)] | — | — | — | 2 |
| $N_2$ [ml/min(normal)] | — | — | 200 | 350 to 400[2)] |
| $B_2H_6$ [ppm(based on $SiH_4$)] | — | 0.5 | 2,000 | — |
| NO [%(based on $SiH_4$)] | 5 | — | — | — |

TABLE 1-continued

| Source gases & conditions | Lower-part charge injection blocking layer | Photo-conductive layer | Upper-part charge injection blocking layer | Surface layer |
|---|---|---|---|---|
| $CO_2$ [%(based on $SiH_4$)] | — | — | — | 2 |
| Substrate temperature: (° C.) | 270 | 260 | 240 | 220 |
| Pressure: (Pa) | 80 | 80 | 55 | 55 |
| RF power: (W) | 200 | 400 | 200 | 200 to 300[2)] |
| Layer thickness: (μm) | 2 | 20 | 0.05 | 0.8 |

[2)]see Table 2

TABLE 2

| | Photosensitive member | $SiH_4$ [ml/min (normal)] | $N_2$ [ml/min (normal)] | Power (W) | N/(Si + N + O + C) (atm %) | Sensitivity to 405 nm light ($Vcm^2/\mu J$) | Surface layer thickness non-uniformity (%) |
|---|---|---|---|---|---|---|---|
| Comparative Example 1-1: | A | 80 | 400 | 300 | 28 | 173 | 12 |
| Example 1: | B | 40 | 400 | 250 | 30 | 307 | 8 |
| | C | 30 | 350 | 200 | 41 | 490 | 8 |
| | D | 20 | 350 | 200 | 60 | 500 | 18 |
| Comparative Example 1-2: | E | 20 | 400 | 200 | 62 | 509 | 33 |

TABLE 3

| Source gases & conditions | Lower = part charge injection blocking layer | Photoconductive layer | Upper = part charge injection blocking layer | Example Photosensitive member G Surface layer | Comparative Ex. Photosensitive member H Surface layer | I Surface layer |
|---|---|---|---|---|---|---|
| $SiH_4$ [ml/min(normal)] | 170 | 170 | 50 | 30 | 20 | 30 |
| $H_2$ [ml/min(normal)] | 600 | 1,000 | 100 | 100 | 100 | 100 |
| $CH_4$ [ml/min(normal)] | — | — | — | 1 | 600 | — |
| $N_2$ [ml/min(normal)] | — | — | 200 | 300 | — | 300 |
| $B_2H_6$ [ppm(based on $SiH_4$)] | — | 0.5 | 2,000 | — | — | — |
| NO [%(based on $SiH_4$)] | 5 | — | — | — | — | — |
| $CO_2$ [%(based on $SiH_4$)] | — | — | — | 2.5 | — | — |
| Substrate temperature: (° C.) | 270 | 260 | 240 | 220 | 260 | 220 |
| Pressure: (Pa) | 80 | 80 | 55 | 50 | 50 | 50 |
| RF power: (W) | 200 | 400 | 200 | 180 | 200 | 180 |
| Layer thickness: (μm) | 2 | 30 | 0.05 | 0.8 | 0.8 | 0.8 |

TABLE 4

| | Photosensitive member | Surface layer Material | Surface layer Addition of O, C | Wavelength of light (nm) | Spot diameter (μm) | Dot pitch (dpi) | Resolution |
|---|---|---|---|---|---|---|---|
| Example 2: | G | SiN | Yes | 405 | 30 | 1,200 | AA |
| Comparative Example 2-2: | I | SiN | No | 405 | 30 | 1,200 | A |
| Comparative Example 2-2: | I | SiN | No | 405 | 60 | 600 | B |
| Comparative Example 2-2: | I | SiN | No | 660 | 60 | 600 | B |
| Comparative Example 2-1: | H | SiC | No | 660 | 60 | 600 | REF |

TABLE 5

| Source gases & conditions | Lower-part charge injection blocking layer | Photo-conductive layer | Upper-part charge injection blocking layer | Surface layer |
|---|---|---|---|---|
| $SiH_4$ [ml/min(normal)] | 200 | 200 | 50 | 25 |
| $H_2$ [ml/min(normal)] | 600 | 750 | 100 | 100 |
| $CH_4$ [ml/min(normal)] | — | — | — | 1 |
| $N_2$ [ml/min(normal)] | — | — | 200 | 300 |
| $B_2H_6$ [ppm(based on $SiH_4$)] | — | — | 2,000 | — |
| NO [% or ppm(based on $SiH_4$)] | 8% | — | — | 30 ppm to 5% |

TABLE 5-continued

| Source gases & conditions | Lower-part charge injection blocking layer | Photo-conductive layer | Upper-part charge injection blocking layer | Surface layer |
|---|---|---|---|---|
| Substrate temperature: (° C.) | 260 | 260 | 240 | 220 |
| Pressure: (Pa) | 65 | 80 | 55 | 50 |
| RF power: (W) | 100 | 400 | 200 | 180 |
| Layer thickness: (μm) | 3 | 30 | 0.05 | 0.8 |

TABLE 6

| Photosensitive member | Flow rate of NO (ppm) | O concentration (atm %) | Dot reproducibility | Image deletion | Residual potential | Photo-memory | Overall evaluation |
|---|---|---|---|---|---|---|---|
| J | 100 | 0.012 | A | A | AA | A | A |
| K | 2,000 | 0.51 | AA | AA | AA | AA | AA |
| L | 5,000 | 1.4 | AA | AA | AA | AA | AA |
| M | 20,000 | 9.7 | AA | AA | AA | AA | AA |
| N | 40,000 | 19.7 | AA | A | A | AA | A |
| O | 30 | 0.004 | B | B | A | B | B |
| P | 50,000 | 21 | AA | B | B | A | B |
| Q | 0 | — | REF | REF | REF | REF | REF |

TABLE 7

| Source gases & conditions | Lower-part charge injection blocking layer | Photo-conductive layer | Upper-part charge injection blocking layer | Surface layer |
|---|---|---|---|---|
| $SiH_4$ [ml/min(normal)] | 200 | 200 | 50 | 20 |
| $H_2$ [ml/min(normal)] | 600 | 750 | 100 | 100 |
| $CH_4$ [ml/min(normal)] | — | — | — | 0.01 to 30[3)] |
| $N_2$ [ml/min(normal)] | — | — | 200 | 300 |
| $B_2H_6$ [ppm(based on $SiH_4$)] | — | — | 2,000 | — |
| NO [% or ppm(based on $SiH_4$)] | 8% | — | — | 2,000 ppm |
| Substrate temperature: (° C.) | 260 | 260 | 240 | 220 |
| Pressure: (Pa) | 65 | 80 | 55 | 50 |
| RF power: (W) | 100 | 400 | 200 | 180 |
| Layer thickness: (μm) | 3 | 30 | 0.05 | 0.8 |

[3)]diluted with $H_2$ when fed at a low flow rate

TABLE 8

| Photosensitive member | $CH_4$ [ml/min (normal)] | C concentration (atm %) | Dot reproducibility ($Vcm^2/\mu J$) | Sensitivity (%) | Residual potential | Photo-memory | Overall evaluation |
|---|---|---|---|---|---|---|---|
| R | 0.03 | 0.014 | A | AA | AA | A | A |
| S | 0.9 | 0.52 | AA | AA | AA | AA | AA |
| T | 3.5 | 2.3 | AA | AA | AA | AA | AA |
| U | 7 | 4.7 | AA | AA | AA | AA | AA |
| V | 18 | 9.6 | AA | A | AA | AA | A |
| W | 0.01 | 0.004 | B | A | A | B | B |
| X | 30 | 13 | AA | C | A | A | C |
| Q | 0 | — | REF | REF | REF | REF | REF |

TABLE 9

| Source gases & conditions | Lower-part charge injection blocking layer | Photo-conductive layer | Upper-part charge injection blocking layer | Photo-sensitive member H, Surface layer |
|---|---|---|---|---|
| $SiH_4$ [ml/min(normal)] | 200 | 200 | 70 | 15 |
| $H_2$ [ml/min(normal)] | 600 | 750 | — | 100 |
| $CH_4$ [ml/min(normal)] | — | — | 150 | — |
| $N_2$ [ml/min(normal)] | — | — | — | Variable[4)] |
| $B_2H_6$ [ppm(based on $SiH_4$)] | — | — | 700 | — |
| NO [%(based on $SiH_4$)] | 8% | — | — | — |

TABLE 9-continued

| Source gases & conditions | Lower-part charge injection blocking layer | Photo-conductive layer | Upper-part charge injection blocking layer | Photo-sensitive member H, Surface layer |
|---|---|---|---|---|
| $CO_2$ [%(based on $SiH_4$)] | — | — | — | Variable[4)] |
| Substrate temperature: (° C.) | 260 | 260 | 240 | 240 |
| Pressure: (Pa) | 65 | 80 | 60 | 60 |
| RF power: (W) | 100 | 400 | 300 | 200 |
| Layer thickness: (μm) | 3 | 30 | 0.1 | 0.7 |

[4)]see Table 10

TABLE 10

| | Photosensitive member | $N_2$ [ml/min (normal)] | $CO_2$ [%(based on $SiH_4$)] | N average concentration (atm %) | O average concentration (atm %) | Dot reproducibility | Photo-memory | Overall evaluation |
|---|---|---|---|---|---|---|---|---|
| Example 5: | CC | 300 | 2 | 50 | 1.5 | REF | REF | REF |
| | AA | 200→400 | 2 | 49 | 1.5 | A | A | A |
| | BB | 300 | 0→4 | 51 | 1.6 | A | A | A |
| | AB | 250→350 | 0→4 | 48 | 1.9 | AA | AA | AA |

TABLE 11

| Source gases & conditions | Lower = part charge injection blocking layer | Photoconductive layer | Gradient = composition layer | Upper = part charge injection blocking layer | Change layer | Surface layer |
|---|---|---|---|---|---|---|
| $SiH_4$ [ml/min(normal)] | 200 | 200 | 200→70 | 70 | 70→15 | 15 |
| $H_2$ [ml/min(normal)] | 600 | 750 | — | — | 0→100 | 100 |
| $CH_4$ [ml/min(normal)] | — | — | — | — | 0→2 | 2 |
| $N_2$ [ml/min(normal)] | — | — | 0→300 | 300 | — | 300 |
| $B_2H_6$ [ppm (based on $SiH_4$)] | — | — | 0→6,000 | 6,000 | 6,000→0 | — |
| NO [% or ppm (based on $SiH_4$)] | 8% | — | — | — | 0→7,000 ppm | 7,000 ppm |
| Substrate temperature: (° C.) | 260 | 260 | 240 | 240 | 240 | 240 |
| Pressure: (Pa) | 65 | 80 | 60 | 60 | 60 | 60 |
| RF power: (W) | 100 | 400 | 200 | 200 | 200 | 200 |

TABLE 11-continued

| Source gases & conditions | Lower = part charge injection blocking layer | Photoconductive layer | Gradient = composition layer | Upper = part charge injection blocking layer | Change layer | Surface layer |
|---|---|---|---|---|---|---|
| Layer thickness: (μm) | 3 | 30 | 0.05 | 0.05 | 0.05 | 0.8 |

TABLE 12

| Photosensitive member | O concentration (atm %) | C concentration (atm %) | Dot reproducibility | Image deletion | Sensitivity | Residual potential | Photo-memory |
|---|---|---|---|---|---|---|---|
| DD | 2 | 0.72 | AA | AA | AA | AA | AA |
| Q | — | — | REF | REF | REF | REF | REF |

TABLE 13

| Source gases & conditions | Lower-part charge injection blocking layer | Photo-conductive layer | Upper-part charge injection blocking layer | Surface layer |
|---|---|---|---|---|
| $SiH_4$ [ml/min(normal)] | 170 | 170 | 100 | 20 to 80[5)] |
| $H_2$ [ml/min(normal)] | 600 | 1,000 | 100 | 100 |
| $CH_4$ [ml/min(normal)] | — | — | 100 | 2 |
| $N_2$ [ml/min(normal)] | — | — | — | 350 to 400[5)] |
| $B_2H_6$ [ppm(based on $SiH_4$)] | — | 0.5 | 200 | — |
| NO [%(based on $SiH_4$)] | 5 | — | — | — |
| $CO_2$ [%(based on $SiH_4$)] | — | — | — | 2 |
| Substrate temperature: (° C.) | 270 | 260 | 240 | 220 |

TABLE 13-continued

| Source gases & conditions | Lower-part charge injection blocking layer | Photo-conductive layer | Upper-part charge injection blocking layer | Surface layer |
|---|---|---|---|---|
| Pressure: (Pa) | 80 | 80 | 55 | 55 |
| RF power: (W) | 200 | 400 | 300 | 200 to 300[5)] |
| Layer thickness: (μm) | 2 | 20 | 0.1 | 0.8 |

[5)]see Table 14

TABLE 14

| | Photosensitive member | $SiH_4$ [ml/min (normal)] | $N_2$ [ml/min (normal)] | Power (W) | N/(Si + N + O + C) (atm %) | Sensitivity to 405 nm light ($Vcm^2/\mu J$) | Surface layer thickness non-uniformity (%) |
|---|---|---|---|---|---|---|---|
| Comparative Example 5-1: | 2A | 80 | 400 | 300 | 28 | 173 | 12 |
| Example 7: | 2B | 40 | 400 | 250 | 30 | 307 | 8 |
| | 2C | 30 | 350 | 200 | 41 | 490 | 8 |
| | 2D | 20 | 350 | 200 | 60 | 500 | 18 |
| Comparative Example 5-2: | 2E | 20 | 400 | 200 | 62 | 509 | 33 |

TABLE 15

| Source gases & conditions | Lower = part charge injection blocking layer | Photoconductive layer | Upper = part charge injection blocking layer | Example Photosensitive member 2G Surface layer | Comparative Ex. Photosensitive member 2H Surface layer | Comparative Ex. Photosensitive member 2I Surface layer |
|---|---|---|---|---|---|---|
| $SiH_4$ [ml/min(normal)] | 170 | 170 | 70 | 30 | 20 | 30 |
| $H_2$ [ml/min(normal)] | 600 | 1,000 | 100 | 100 | 100 | 100 |
| $CH_4$ [ml/min(normal)] | — | — | 100 | 1 | 600 | — |
| $N_2$ [ml/min(normal)] | — | — | — | 300 | — | 300 |
| $B_2H_6$ [ppm(based on $SiH_4$)] | — | 0.5 | 400 | — | — | — |
| NO [%(based on $SiH_4$)] | 5 | — | — | — | — | — |

TABLE 15-continued

| Source gases & conditions | Lower = part charge injection blocking layer | Photoconductive layer | Upper = part charge injection blocking layer | Example Photosensitive member 2G Surface layer | Comparative Ex. Photosensitive member 2H Surface layer | 2I Surface layer |
|---|---|---|---|---|---|---|
| $CO_2$ [%(based on $SiH_4$)] | — | — | — | 2.5 | — | — |
| Substrate temperature: (° C.) | 270 | 260 | 240 | 220 | 260 | 220 |
| Pressure: (Pa) | 80 | 80 | 55 | 50 | 50 | 50 |
| RF power: (W) | 200 | 400 | 300 | 180 | 200 | 180 |
| Layer thickness: (μm) | 2 | 30 | 0.07 | 0.8 | 0.8 | 0.8 |

TABLE 16

| | Photosensitive member | Surface layer Material | Surface layer Addition of O, C | Wavelength of light (nm) | Spot diameter (μm) | Dot pitch (dpi) | Resolution |
|---|---|---|---|---|---|---|---|
| Example 8: | 2G | SiN | Yes | 405 | 30 | 1,200 | AA |
| Comparative Example 6-2: | 2I | SiN | No | 405 | 30 | 1,200 | A |
| Comparative Example 6-2: | 2I | SiN | No | 405 | 60 | 600 | B |
| Comparative Example 6-2: | 2I | SiN | No | 660 | 60 | 600 | B |
| Comparative Example 6-1: | 2H | SiC | No | 660 | 60 | 600 | REF |

TABLE 17

| Source gases & conditions | Lower-part charge injection blocking layer | Photo-conductive layer | Upper-part charge injection blocking layer | Surface layer |
|---|---|---|---|---|
| $SiH_4$ [ml/min(normal)] | 200 | 200 | 100 | 25 |
| $H_2$ [ml/min(normal)] | 600 | 750 | — | 100 |
| $CH_4$ [ml/min(normal)] | — | — | 100 | 1 |
| $N_2$ [ml/min(normal)] | — | — | — | 300 |
| $B_2H_6$ [ppm(based on $SiH_4$)] | — | — | 300 | — |
| NO [% or ppm(based on $SiH_4$)] | 8% | — | — | 30 ppm to 5% |

TABLE 17-continued

| Source gases & conditions | Lower-part charge injection blocking layer | Photo-conductive layer | Upper-part charge injection blocking layer | Surface layer |
|---|---|---|---|---|
| Substrate temperature: (° C.) | 260 | 260 | 240 | 220 |
| Pressure: (Pa) | 65 | 80 | 55 | 50 |
| RF power: (W) | 100 | 400 | 200 | 180 |
| Layer thickness: (μm) | 3 | 30 | 0.02 | 0.8 |

TABLE 18

| Photosensitive member | Amount of NO (ppm) | O concentration (atm %) | Dot reproducibility | Image deletion | Residual potential | Photo-memory | Overall evaluation |
|---|---|---|---|---|---|---|---|
| 2J | 100 | 0.012 | A | A | AA | A | A |
| 2K | 2,000 | 0.51 | AA | AA | AA | AA | AA |
| 2L | 5,000 | 1.4 | AA | AA | AA | AA | AA |
| 2M | 20,000 | 9.7 | AA | AA | AA | AA | AA |
| 2N | 40,000 | 19.7 | AA | A | A | AA | A |
| 2O | 30 | 0.004 | B | B | A | B | B |
| 2P | 50,000 | 21 | AA | B | B | A | B |
| 2Q | 0 | — | REF | REF | REF | REF | REF |

TABLE 19

| Source gases & conditions | Lower-part charge injection blocking layer | Photo-conductive layer | Upper-part charge injection blocking layer | Surface layer |
|---|---|---|---|---|
| $SiH_4$ [ml/min(normal)] | 200 | 200 | 80 | 25 |
| $H_2$ [ml/min(normal)] | 600 | 750 | — | 100 |
| $CH_4$ [ml/min(normal)] | — | — | 120 | 0.01 to 30[6)] |
| $N_2$ [ml/min(normal)] | — | — | — | 300 |
| $B_2H_6$ [ppm(based on $SiH_4$)] | — | — | 400 | — |
| NO [% or ppm(based on $SiH_4$)] | 8% | — | — | 2,000 ppm |

TABLE 19-continued

| Source gases & conditions | Lower-part charge injection blocking layer | Photo-conductive layer | Upper-part charge injection blocking layer | Surface layer |
|---|---|---|---|---|
| Substrate temperature: (° C.) | 260 | 260 | 240 | 220 |
| Pressure: (Pa) | 65 | 80 | 55 | 50 |
| RF power: (W) | 100 | 400 | 300 | 180 |
| Layer thickness: (μm) | 3 | 30 | 0.08 | 0.8 |

[6)]diluted with $H_2$ when fed at a low flow rate

TABLE 20

| Photosensitive member | $CH_4$ [ml/min (normal)] | C concentration (atm %) | Dot reproducibility ($Vcm^2/\mu J$) | Sensitivity (%) | Residual potential | Photo-memory | Overall evaluation |
|---|---|---|---|---|---|---|---|
| 2R | 0.03 | 0.014 | A | AA | AA | A | A |
| 2S | 0.9 | 0.52 | AA | AA | AA | AA | AA |
| 2T | 3.5 | 2.3 | AA | AA | AA | AA | AA |
| 2U | 7 | 4.7 | AA | A | AA | AA | AA |
| 2V | 18 | 9.6 | AA | A | AA | AA | A |
| 2W | 0.01 | 0.004 | B | A | A | B | B |
| 2X | 30 | 13 | AA | C | A | A | C |
| 2Q | 0 | — | REF | REF | REF | REF | REF |

TABLE 21

| Source gases & conditions | Lower-part charge injection blocking layer | Photo-conductive layer | Upper-part charge injection blocking layer | Surface layer |
|---|---|---|---|---|
| $SiH_4$ [ml/min(normal)] | 200 | 200 | 70 | 15 |
| $H_2$ [ml/min(normal)] | 600 | 750 | — | 100 |
| $CH_4$ [ml/min(normal)] | — | — | 150 | — |
| $N_2$ [ml/min(normal)] | — | — | — | Variable[7)] |
| $B_2H_6$ [ppm(based on $SiH_4$)] | — | — | 700 | — |
| NO [%(based on $SiH_4$)] | 8% | — | — | — |
| $CO_2$ [%(based on $SiH_4$)] | — | — | — | Variable[7)] |
| Substrate temperature: (° C.) | 260 | 260 | 240 | 240 |
| Pressure: (Pa) | 65 | 80 | 60 | 60 |
| RF power: (W) | 100 | 400 | 300 | 200 |
| Layer thickness: (μm) | 3 | 30 | 0.1 | 0.7 |

[7)]see Table 22

TABLE 22

| | Photosensitive member | $N_2$ [ml/min (normal)] | $CO_2$ [%(based on $SiH_4$)] | N average concentration (atm %) | O average concentration (atm %) | Dot reproducibility | Photo-memory | Overall evaluation |
|---|---|---|---|---|---|---|---|---|
| Example 11: | 2CC | 300 | 2 | 50 | 1.5 | REF | REF | REF |
| | 2AA | 200→400 | 2 | 49 | 1.5 | A | A | A |
| | 2BB | 300 | 0→4 | 51 | 1.8 | A | A | A |
| | 2AB | 250→350 | 0→4 | 48 | 1.9 | AA | AA | AA |

TABLE 23

| Source gases & conditions | Lower = part charge injection blocking layer | Photoconductive layer | Gradient = composition layer | Upper = part charge injection blocking layer | Change layer | Surface layer |
|---|---|---|---|---|---|---|
| $SiH_4$ [ml/min(normal)] | 200 | 200 | 200→70 | 70 | 70→15 | 15 |
| $H_2$ [ml/min(normal)] | 600 | 750 | — | — | 0→100 | 100 |
| $CH_4$ [ml/min(normal)] | — | — | 0→300 | 120 | 120→2 | 2 |
| $N_2$ [ml/min(normal)] | — | — | — | — | 0→300 | 300 |
| $B_2H_6$ [ppm (based on $SiH_4$)] | — | — | 0→600 | 600 | 600→0 | — |
| NO [% or ppm (based on $SiH_4$)] | 8% | — | — | — | 0→7,000 ppm | 7,000 ppm |
| Substrate temperature: (° C.) | 260 | 260 | 240 | 240 | 240 | 240 |
| Pressure: (Pa) | 65 | 80 | 60 | 60 | 60 | 60 |
| RF power: (W) | 100 | 400 | 200 | 200 | 200 | 200 |
| Layer thickness: (μm) | 3 | 30 | 0.05 | 0.05 | 0.05 | 0.8 |

TABLE 24

| Photosensitive member | O concentration (atm %) | C concentration (atm %) | Dot reproducibility | Smeared images | Sensitivity | Residual potential | Photo-memory |
|---|---|---|---|---|---|---|---|
| 2DD | 2 | 0.72 | AA | AA | AA | AA | AA |
| 2Q | — | — | REF | REF | REF | REF | REF |

TABLE 25

| Source gases & conditions | Lower-part charge injection blocking layer | Photo-conductive layer | Upper-part charge injection blocking layer | Surface layer |
|---|---|---|---|---|
| $SiH_4$ [ml/min(normal)] | 200 | 200 | 70 | 15 |
| $H_2$ [ml/min(normal)] | 600 | 750 | — | 100 |
| $CH_4$ [ml/min(normal)] | — | — | 30 to 700[8)] | — |
| $N_2$ [ml/min(normal)] | — | — | — | 200 |
| $B_2H_6$ [ppm(based on $SiH_4$)] | — | — | 400 | — |
| NO [%(based on $SiH_4$)] | 8 | — | — | — |
| $CO_2$ [%(based on $SiH_4$)] | — | — | — | 2 |
| Substrate temperature: (° C.) | 260 | 260 | 240 | 240 |
| Pressure: (Pa) | 65 | 80 | 60 | 60 |
| RF power: (W) | 100 | 400 | 300 | 200 |
| Layer thickness: (μm) | 3 | 30 | 0.05 | 0.7 |

[8)]see Table 26

TABLE 26

| Photosensitive member | $CH_4$ [ml/min (normal)] | C(Si + C) (atm %) | Charge-ability | Sensitivity | Overall evaluation |
|---|---|---|---|---|---|
| 2FF | 50 | 10 | A | A | A |
| 2GG | 70 | 15 | AA | AA | AA |
| 2HH | 120 | 25 | AA | AA | AA |
| 2II | 300 | 40 | AA | AA | AA |
| 2JJ | 700 | 50 | B | AA | A |
| 2EE | 30 | 8 | REF | REF | REF |

TABLE 27

| Source gases & conditions | Lower-part charge injection blocking layer | Photo-conductive layer | Upper-part charge injection blocking layer | Surface layer |
|---|---|---|---|---|
| $SiH_4$ [ml/min(normal)] | 200 | 200 | 80 | 15 |
| $H_2$ [ml/min(normal)] | 600 | 750 | — | 100 |
| $CH_4$ [ml/min(normal)] | — | — | 200 | — |
| $N_2$ [ml/min(normal)] | — | — | — | 200 |
| $B_2H_6$ [ppm(based | — | — | 7 to 5,000[9)] | — |

TABLE 27-continued

| Source gases & conditions | Lower-part charge injection blocking layer | Photo-conductive layer | Upper-part charge injection blocking layer | Surface layer |
|---|---|---|---|---|
| on $SiH_4$)] | | | | |
| NO [%(based on $SiH_4$)] | 8 | — | — | — |
| $CO_2$ [%(based on $SiH_4$)] | — | — | — | 2 |
| Substrate temperature: (° C.) | 260 | 260 | 240 | 240 |
| Pressure: (Pa) | 65 | 80 | 60 | 60 |
| RF power: (W) | 100 | 400 | 300 | 200 |
| Layer thickness: (μm) | 3 | 30 | 0.07 | 0.7 |

[9)]see Table 28

TABLE 28

| | Photosensitive member | $B_2H_6$ [ppm(based on $SiH_4$)] | B content (atmppm) | Chargeability (atm %) | Resolution | Overall evaluation |
|---|---|---|---|---|---|---|
| Example 14: | 2PP | 5,000 | 4,000 | REF | REF | REF |
| | 2KK | 70 | 50 | A | AA | A |
| | 2LL | 120 | 100 | AA | AA | AA |
| | 2MM | 1,500 | 1,000 | AA | AA | AA |
| | 2NN | 2,800 | 2,000 | AA | AA | AA |
| | 2OO | 4,000 | 3,000A | A | A | A |

TABLE 29

| Source gases & conditions | Lower-part charge injection blocking layer | Photo-conductive layer | Upper-part charge injection blocking layer | Surface layer |
|---|---|---|---|---|
| $SiH_4$ [ml/min(normal)] | 200 | 200 | 90 | 15 |
| $H_2$ [ml/min(normal)] | 600 | 750 | — | 100 |
| $CH_4$ [ml/min(normal)] | — | — | 120 | — |
| $N_2$ [ml/min(normal)] | — | — | — | 200 |
| $B_2H_6$ [ppm(based on $SiH_4$)] | — | — | 500 | — |
| NO [%(based on $SiH_4$)] | 8 | — | — | — |
| $CO_2$ [%(based on $SiH_4$)] | — | — | — | 2 |
| Substrate temperature: (° C.) | 260 | 260 | 240 | 240 |
| Pressure: (Pa) | 65 | 80 | 60 | 60 |
| RF power: (W) | 100 | 400 | 300 | 200 |
| Layer thickness: (μm) | 3 | 30 | 0.005 to 0.2[10)] | 0.7 |

[10)]see Table 30

TABLE 30

| | Photo-sensitive member | Layer thickness (nm) | Charge-ability | Sensitivity | Overall evaluation |
|---|---|---|---|---|---|
| Example 15: | 2VV | 200 | REF | REF | REF |
| | 2QQ | 5 | AA | AA | AA |
| | 2RR | 30 | AA | AA | AA |
| | 2SS | 50 | AA | AA | AA |

TABLE 30-continued

| | Photo-sensitive member | Layer thickness (nm) | Charge-ability | Sensitivity | Overall evaluation |
|---|---|---|---|---|---|
| | 2TT | 100 | AA | A | A |
| | 2UUU | 150 | B | B | B |

This application claims priorities from Japanese Patent Application Nos. 2004-322760 filed on Nov. 5, 2004, and 2004-322772 filed on Nov. 5, 2004, which are hereby incorporated by reference herein.

What is claimed is:

1. An electrophotographic photosensitive member comprising a substrate, and a photoconductive layer and a surface layer in this order provided on the substrate, wherein;

said surface layer comprises an amorphous material composed chiefly of silicon atoms and nitrogen atoms and containing at least oxygen atoms and carbon atoms, and in said amorphous material, oxygen atoms, carbon atoms and nitrogen atoms are contained in average concentrations represented respectively by the following expressions (1) to (3):

$$0.0001 \leqq O/(Si+N+O+C) \leqq 0.2 \quad (1)$$

$$0.0001 \leqq C/(Si+N+O+C) \leqq 0.1 \quad (2)$$

$$0.3 \leqq N/(Si+N+O+C) \leqq 0.6 \quad (3)$$

(in the expressions (1) to (3), Si represents the number of silicon atoms, N represents the number of nitrogen atoms, O represents the number of oxygen atoms, and C represents the number of carbon atoms).

2. The electrophotographic photosensitive member according to claim 1, wherein said amorphous material constituting said surface layer, composed chiefly of silicon atoms and nitrogen atoms and containing at least oxygen atoms and carbon atoms, contains oxygen atoms in an average concentration represented by the following expression (1a):

$$0.005 \leqq O/(Si+N+O+C) \leqq 0.1 \quad (1a)$$

(wherein Si represents the number of silicon atoms, N represents the number of nitrogen atoms, O represents the number of oxygen atoms, and C represents the number of carbon atoms).

3. The electrophotographic photosensitive member according to claim 1, wherein said amorphous material constituting said surface layer, composed chiefly of silicon atoms and nitrogen atoms and containing at least oxygen atoms and carbon atoms, contains carbon atoms in an average concentration represented by the following expression (2a):

$$0.005 \leqq C/(Si+N+O+C) \leqq 0.05 \quad (2a)$$

(wherein Si represents the number of silicon atoms, N represents the number of nitrogen atoms, O represents the number of oxygen atoms, and C represents the number of carbon atoms).

4. The electrophotographic photosensitive member according to claim 1, wherein nitrogen atoms are contained in an average concentration by the following expression (3a):

$$0.35 \leqq N/(Si+N+O+C) \leqq 0.55 \quad (3a)$$

(wherein Si represents the number of silicon atoms, N represents the number of nitrogen atoms, O represents the number of oxygen atoms, and C represents the number of carbon atoms).

5. The electrophotographic photosensitive member according to claim 1, wherein said surface layer contains oxygen atoms in a gradient composition in which their concentration increases toward the open surface.

6. The electrophotographic photosensitive member according to claim 1, wherein said surface layer contains nitrogen atoms in a gradient composition in which their concentration increases toward the open surface.

7. The electrophotographic photosensitive member according to claim 1, wherein said surface layer contains nitrogen atoms and oxygen atoms in such a way that a value of O/N which is a ratio of the number O of oxygen atoms contained per unit length in the thickness direction to the number N of nitrogen atoms contained per unit length in the thickness direction increases toward an open surface.

8. The electrophotographic photosensitive member according to claim 1, wherein said photoconductive layer contains an amorphous material composed chiefly of silicon atoms and containing hydrogen atoms.

9. The electrophotographic photosensitive member according to claim 1, which has, between said photoconductive layer and said surface layer, an upper-part charge injection blocking layer composed chiefly of silicon atoms and nitrogen atoms and containing a periodic-table Group 13 element.

10. The electrophotographic photosensitive member according to claim 9, which has i) between said photoconductive layer and said upper-part charge injection blocking layer a gradient-composition layer comprising an amorphous material composed chiefly of silicon atoms and nitrogen atoms and containing silicon atoms and nitrogen atoms in such a way that a value of N/Si which is a ratio of the number Si of silicon atoms contained per unit length in the thickness direction to the number N of nitrogen atoms contained per unit length in the thickness direction increases toward the upper-part charge injection blocking layer and/or ii) between said upper-part charge injection blocking layer and said surface layer a change layer comprising an amorphous material composed chiefly of silicon atoms, nitrogen atoms and carbon atoms and containing silicon atoms, nitrogen atoms and carbon atoms in such a way that a compositional ratio between the number of silicon atoms, the number of nitrogen atoms and the number of carbon atoms which are contained per unit length in the thickness direction changes continuously.

11. The electrophotographic photosensitive member according to claim 1, which has, between said photoconductive layer and said surface layer, an upper-part charge injection blocking layer composed chiefly of silicon atoms and carbon atoms and containing a periodic-table Group 13 element.

12. The electrophotographic photosensitive member according to claim 11, wherein the amorphous material constituting said upper-part charge injection blocking layer, composed chiefly of silicon atoms and carbon atoms and containing at least a periodic-table Group 13 element, contains carbon atoms in an average concentration represented by the following expression (4):

$$0.1 \leqq C/(Si+C) \leqq 0.5 \quad (4)$$

(wherein Si represents the number of silicon atoms and C represents the number of carbon atoms).

13. The electrophotographic photosensitive member according to claim 11, wherein the amorphous material constituting said upper-part charge injection blocking layer, composed chiefly of silicon atoms and carbon atoms and containing at least a periodic-table Group 13 element, contains the periodic-table Group 13 element in an average concentration represented by the expression (5):

$$50 \times 10^{-6} \leqq X/Si \leqq 3{,}000 \times 10^{-6} \quad (5)$$

(wherein X represents the number of the periodic-table Group 13 element and Si represents the number of silicon atoms).

14. The electrophotographic photosensitive member according to claim 9, wherein said upper-part charge injection blocking layer has a thickness of from 5 nm or more to 150 nm or less.

15. The electrophotographic photosensitive member according to claim 11, which has i) between said photoconductive layer and said upper-part charge injection blocking layer a gradient-composition layer comprising an amorphous material composed chiefly of silicon atoms and carbon atoms and containing silicon atoms and carbon atoms in such a way that a value of C/Si which is the ratio of the number Si of silicon atoms contained per unit length in the thickness direction to the number C of carbon atoms contained per unit length in the thickness direction increases toward the upper-part charge injection blocking layer and/or ii) between said upper-part charge injection blocking layer and said surface layer a change layer comprising an amorphous material composed chiefly of silicon atoms, nitrogen atoms and carbon atoms and containing silicon atoms, nitrogen atoms and carbon atoms in such a way that the compositional ratio between the number of silicon atoms, the number of nitrogen atoms and the number of carbon atoms which are contained per unit length in the thickness direction changes continuously.

16. The electrophotographic photosensitive member according to claims 1, which has a potential attenuation level of 300 $Vcm^2/\mu J$ or more per unit energy quantity of a laser beam of 405 nm in wavelength.

17. An electrophotographic apparatus which is provided with the electrophotographic photosensitive member according to claim 1.

* * * * *

UNITED STATES PATENT AND TRADEMARK OFFICE

CERTIFICATE OF CORRECTION

PATENT NO. : 7,157,197 B2
APPLICATION NO. : 11/377388
DATED : January 2, 2007
INVENTOR(S) : Makoto Aoki et al.

It is certified that error appears in the above-identified patent and that said Letters Patent is hereby corrected as shown below:

ON THE TITLE PAGE [56] REFERENCES CITED:

FOREIGN PATENT DOCUMENTS, "02012264 A" should read --2-012264 A--.

COLUMN 2:

Line 2, "in stability" should read --instability--.

COLUMN 3:

Line 21, "lense," (both occurrences) should read --lens,--.

COLUMN 7:

Line 35, "be so act" should read --act so--.

COLUMN 8:

Line 11, "aroms" (both occurrences) should read --atoms--.
Line 28, "it" should read --It--.

COLUMN 15:

Line 25, "balances" should read --balanced--.
Line 41, "Group 14" should read --Group 15--.

COLUMN 17:

Line 9, "alos" should read --also--.

COLUMN 18:

Line 49, "form" should read --from--.

COLUMN 25:

Line 12, "sill" should read --still--.
Line 54, "refrred" should read --referred--.

UNITED STATES PATENT AND TRADEMARK OFFICE

CERTIFICATE OF CORRECTION

PATENT NO. : 7,157,197 B2
APPLICATION NO. : 11/377388
DATED : January 2, 2007
INVENTOR(S) : Makoto Aoki et al.

It is certified that error appears in the above-identified patent and that said Letters Patent is hereby corrected as shown below:

COLUMN 27:

Line 15, “are” should be deleted.
Line 52, “adhere” should read --adheres--.

COLUMN 28:

Line 18, “hold” should read --holds--.

COLUMN 32:

Line 54, “Shown” should read --shown--.

COLUMN 34:

Line 54, “Iimage” should read --Image--.

COLUMN 38:

Line 19, “creaeted” should read --created--.

COLUMN 43:

Line 53, “gase” should read --gases--.

COLUMN 45:

Line 12, “high” should read --highly--.
Line 16, “low” should read --lowly--.

COLUMN 46:

Line 18, “produce” should read --producing--.
Line 44, “somewnat” should read --somewhat--.

COLUMN 47:

Table 3, “Lower=part” should read --Lower-part--, and “Upper=part” should read --Upper-part--.

UNITED STATES PATENT AND TRADEMARK OFFICE

CERTIFICATE OF CORRECTION

PATENT NO. : 7,157,197 B2
APPLICATION NO. : 11/377388
DATED : January 2, 2007
INVENTOR(S) : Makoto Aoki et al.

It is certified that error appears in the above-identified patent and that said Letters Patent is hereby corrected as shown below:

COLUMN 51:

Table 11, "Lower=part" should read --Lower-part--, and "Upper=part" should read --Upper-part--.

COLUMN 53:

Table 11, "Lower=part" should read --Lower-part--, and "Upper=part" should read --Upper-part--.
Table 15, "Lower=part" should read --Lower-part--, and "Upper=part" should read --Upper-part--.

COLUMN 55:

Table 15, "Lower=part" should read --Lower-part--, and "Upper=part" should read --Upper-part--.

COLUMN 59:

Table 23, "Lower=part" should read --Lower-part--, and "Upper=part" should read --Upper-part--.

COLUMN 63:

Line 4, "$0.005 \leqq C/(Si+N+O+C) \leqq 0.05$ (2a)" should read --$0.005 \leqq C/(Si+N+O+C) \leqq 0.05$ (2a)--.

UNITED STATES PATENT AND TRADEMARK OFFICE

CERTIFICATE OF CORRECTION

PATENT NO. : 7,157,197 B2
APPLICATION NO. : 11/377388
DATED : January 2, 2007
INVENTOR(S) : Makoto Aoki et al.

It is certified that error appears in the above-identified patent and that said Letters Patent is hereby corrected as shown below:

COLUMN 64:

Line 56, "claims" should read --claim--.

Signed and Sealed this

Nineteenth Day of August, 2008

JON W. DUDAS
*Director of the United States Patent and Trademark Office*